US011602864B1

(12) United States Patent
Perkins

(10) Patent No.: US 11,602,864 B1
(45) Date of Patent: Mar. 14, 2023

(54) ASSISTED OPENING KNIFE BLADE

(71) Applicant: Alexander Perkins, Chesapeake, VA (US)

(72) Inventor: Alexander Perkins, Chesapeake, VA (US)

( * ) Notice: Subject to any disclaimer, the term of this patent is extended or adjusted under 35 U.S.C. 154(b) by 85 days.

(21) Appl. No.: 16/852,926

(22) Filed: Apr. 20, 2020

Related U.S. Application Data

(60) Provisional application No. 62/840,477, filed on Apr. 30, 2019.

(51) Int. Cl.
*B26B 1/02* (2006.01)

(52) U.S. Cl.
CPC ..... *B26B 1/02* (2013.01)

(58) Field of Classification Search
CPC ..... B26B 1/00; B26B 1/02; B26B 1/04
See application file for complete search history.

(56) References Cited

U.S. PATENT DOCUMENTS

| | | | | |
|---|---|---|---|---|
| 4,095,337 | A * | 6/1978 | Pharr | B26B 1/00 30/158 |
| 7,036,229 | B1 * | 5/2006 | Demko | B26B 1/02 30/160 |
| 8,402,662 | B1 * | 3/2013 | Douzanis | B26B 29/02 30/161 |
| 9,682,487 | B1 * | 6/2017 | Nykoluk | B26B 9/00 |
| 2006/0272158 | A1 * | 12/2006 | Williams | B26B 1/044 30/161 |
| 2014/0115900 | A1 * | 5/2014 | Ikoma | B26B 1/042 30/161 |
| 2015/0251324 | A1 * | 9/2015 | Tkachenko | B26B 1/02 30/155 |
| 2018/0354144 | A1 * | 12/2018 | LeBlanc | B25G 1/08 |

* cited by examiner

*Primary Examiner* — Jennifer S Matthews
(74) *Attorney, Agent, or Firm* — Shaddock Law Group, PC

(57) ABSTRACT

An assisted opening knife blade having a knife blade and at least two blade projections extending from the knife blade, wherein a proximal end of each blade projection extends beyond a side surface of the knife blade.

18 Claims, 29 Drawing Sheets

ASSISTED OPENING KNIFE BLADE

CROSS-REFERENCE TO RELATED APPLICATIONS

This patent application claims the benefit of U.S. Patent Application Ser. No. 62/840,477, filed Apr. 30, 2019, the disclosure of which is incorporated herein by reference in its entirety.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of folding knives. More specifically, the presently disclosed systems, methods, and/or apparatuses relates to an assisted opening knife blade for use with a folding life.

2. Description of Related Art

A folding knife or pocketknife is a foldable knife with one or more blades or tools that pivot and fit within at least a portion of the handle of the knife and could still be placed within one's pocket. Pocket knives are very versatile tools and can provide a wide variety of cutting usabilities, anything from work related needs, to food preparations, to emergency or self-defense situations.

There are key points in history that show us how the pocketknife has evolved into several distinctive variations. Some variations are very simplistic in design, while others have become complicated. The earliest known pocket knives predate the early Iron Age. These early knives had a very simplistic and basic design, wherein the blade pivoted and folded in and out of the handle freely without the use of any tension mechanisms or locking mechanisms.

Through the invention of Slip Joints, a pocketknife could now hold its blade in place through the use of tension by the use of either a back-spring or a flat bar. These mechanisms placed a certain amount of pressure on the blade, thus holding the blade into place, in either an open or closed position. Slip joint knives paved the way for other such knives, such as the Multitool, to be developed.

Through the invention of the Lock Blade Knife or Clasp Knife, the pocketknife's blade could be safely locked into its fully open position. Lock blade knives improved overall safety by preventing accidental blade closure on the user while the knife was cutting or in use. To disengage the lock, a button or lever must be pressed inward in order to allow the blade to fold into the handle.

The Folding Hunting Knife became popular with sportsmen. The folding hunting knife saw use with military personnel as it could perform a variety of tasks. Custom knife makers began making similar knives, in particular was knife maker Bob Terzuola, who is credited with coining the phrase "Tactical Folder".

The Tactical Folder began in the early 1990s and has since become very popular in the United States. These sorts of blades are most commonly built with liner locks. The tactical knife blade lengths vary, but do not extend over 4 inches for legal reasons within US jurisdictions. These knives tend to have synthetic handles that grip really well. The blades are usually coated with a non-reflective finish. These knife types are designed for harsh environments and to be put through extensive abuse when used.

Tactical knives can be designed for rapid blade deployment. Speed has become a key element when designing most of the tactical knives for today's market. Leading to the creation of knives capable of deploying a blade very quickly. These quick deployment knives can opened one handed with the push of a button, the flick of the wrist, or the flick of a finger. All variations are fast in their own right.

An assisted opening knife, or a spring-assisted knife, is a knife that includes a spring or torsion mechanism. As the user begins opening the blade with a thumb stud or flipper lever, the blade pivots to a point at which the spring or torsion mechanism engages the knife blade and pivots the blade toward the open position.

Any discussion of documents, acts, materials, devices, articles, or the like, which have been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, known tactical knives or other knives having rapid deployment blades do not have a way to consistently open or deploy the knife blade, as the knife is withdrawn from a user's pocket. Thus, to overcome these and other shortcomings of the current tactical or rapid deployment knives, the present disclosure provides, among other things, an assisted opening knife blade having at least one blade projection component that can quickly, effectively, and consistently be opened or deployed, as the knife is being withdrawn from a user's pocket or other carrying case.

The assisted opening knife blade of the present disclosure creates a pocketknife capable of reaching the fastest deployment speeds possible. The design of the assisted opening knife blade provides the blade with the highest chance of deployment through the use of one or more fin like projections that extend from the spine of a blade, proximate the knife blade's pivoting pin aperture. No other such method of snagging a pockets lining or containment pouch has been made. All other current snag knives are created with a singular projection that extends within the same plane as the blade of the knife. This one projection offers limited directional snag catch-ability, meaning there is less of a chance for a successful knife deployment. The unique design of the assisted opening knife blade of the present disclosure pushes beyond those limitations and offers the maximum amount of snag directional catch-ability. Thus, making the assisted opening knife blade of the present disclosure a new class of snag knife technology. The multiple fin like projections put this snag knife into a class of its own.

The disclosed assisted opening knife blade and be utilized to create a pocketknife capable of simultaneously handling many directions of snag coverage throughout a pocket's or containment pouch's inner lining. The greater the amount of the projections facing outwards grants a higher successful catch-ability rate of the knife being able to automatically deploy its blade. A single mounted projection is severely limited to just one direction of snag coverage. This limitation affects the overall success rate of the knife's ability to automatically deploy its blade during the knife's withdrawal.

In various exemplary, non-limiting embodiments, the disclosed assisted opening knife blade comprises a blade with multiple fin like projections mounted on the spine, proximate the blade's pivoting pin aperture. The pivoting pin aperture can use either standard bushings or ball bearings to pivot. Both pivoting methods have their own pros and cons. The knife's blade will have the ability to fold within its handle and preferably be able to lock into the opened position through the use of a locking mechanism. The locking mechanism is preferred in order to prevent unwarranted harm from accidental blade closure to the user during the use of the knife.

In various exemplary, non-limiting embodiments, the fin like projections may include shapes such as prongs, horns, hooks, jagged spikes, sharp edges, or humps covered in "Jimping" (notches for grip). The leading edges of the projections are pointed outward and towards the knife's blade tip. These projections snag the inner lining of a pocket or containment pouch and will cling in place as the motion of the withdrawal causes the blade to pivot against that lining. It is also during this pivoting action that the blade's projections lose their ability to snag the lining materials and will release the lining as the blade reaches its maximum rotation.

In various exemplary, non-limiting embodiments, the disclosed assisted opening knife blade comprises a knife blade; and at least two blade projections extending from the knife blade, wherein a proximal end of each blade projection extends beyond a side surface of the knife blade.

In various exemplary, non-limiting embodiments, the disclosed assisted opening knife blade comprises a knife blade; and two or more blade projections extending from the knife blade, wherein at least two of the blade projections extend from a spine of the knife blade away from a sagittal plane of the knife blade.

In various exemplary, non-limiting embodiments, each of the blade projections extends from the knife blade proximate a pivot point of the knife blade.

In various exemplary, non-limiting embodiments, a terminal end portion of each blade projection extends beyond a plane formed by a side surface of the knife blade.

In various exemplary, non-limiting embodiments, one or more surfaces of each of the blade projections includes a textured portion.

In various exemplary, non-limiting embodiments, each of the blade projections is formed as an integral portion of the knife blade.

In various exemplary, non-limiting embodiments, the blade projections are portions of a blade projection module, wherein the blade projection module is attached or coupled to the knife blade.

In various exemplary, non-limiting embodiments, an angle formed between the blade projections is an acute angle.

In various exemplary, non-limiting embodiments, the disclosed blade projection module for a knife blade comprises two or more blade projections, wherein each of the blade projections extends from a portion of the blade projection module, and wherein the blade projection module is configured to be attached or coupled to the knife blade.

In various exemplary, non-limiting embodiments, an angle formed between the blade projections is an acute angle.

In various exemplary, non-limiting embodiments, at least one fastener aperture is formed through the blade projection module, so as to be aligned with one or more corresponding blade fastener recesses formed through the knife blade, such that at least one fastener may be positioned through the aligned at least one fastener aperture and at least partially within the aligned at least one blade fastener recess.

In various exemplary, non-limiting embodiments, the blade projection module is attached or coupled to the knife blade.

In various exemplary, non-limiting embodiments, one or two projection extensions extend from the blade projection module, wherein each projection extension is formed so as to be positionable adjacent at least a portion of a surface of the knife blade.

In various exemplary, non-limiting embodiments, at least one fastener aperture is formed through each of the projection extensions.

In various exemplary, non-limiting embodiments, a securing projection extends from at least one of the projection extensions, wherein the projection extension is positionable through a blade aperture formed through the knife blade.

Accordingly, the presently disclosed systems, methods, and/or apparatuses separately and optionally provide an assisted opening knife blade with the ability to assist in pivoting the blade from a closed to an open position.

The presently disclosed systems, methods, and/or apparatuses separately and optionally provide an assisted opening knife blade having at least two prominent fin like projections that are mounted on the spine of the blade, proximate the knife's tang or pivot pin.

The presently disclosed systems, methods, and/or apparatuses separately and optionally provide an assisted opening knife blade having at least two prominent fin like projections that have the ability to snag a pocket's or containment pouch's inner lining materials to allow the knife blade to pivot open as the knife is being withdrawn from the pocket or containment pouch.

These and other aspects, features, and advantages of the presently disclosed systems, methods, and/or apparatuses are described in or are apparent from the following detailed description of the exemplary, non-limiting embodiments of the presently disclosed systems, methods, and/or apparatuses and the accompanying figures. Other aspects and features of embodiments of the presently disclosed systems, methods, and/or apparatuses will become apparent to those of ordinary skill in the art upon reviewing the following description of specific, exemplary embodiments of the presently disclosed systems, methods, and/or apparatuses in concert with the figures.

While features of the presently disclosed systems, methods, and/or apparatuses may be discussed relative to certain embodiments and figures, all embodiments of the presently disclosed systems, methods, and/or apparatuses can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the presently disclosed systems, methods, and/or apparatuses.

Any benefits, advantages, or solutions to problems that are described herein with regard to specific embodiments are not intended to be construed as a critical, required, or essential feature(s) or element(s) of the presently disclosed systems, methods, and/or apparatuses or the claims.

BRIEF DESCRIPTION OF THE SEVERAL VIEWS OF THE DRAWINGS

As required, detailed exemplary embodiments of the presently disclosed systems, methods, and/or apparatuses are disclosed herein; however, it is to be understood that the disclosed embodiments are merely exemplary of the presently disclosed systems, methods, and/or apparatuses that may be embodied in various and alternative forms, within the scope of the presently disclosed systems, methods, and/or apparatuses. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the presently disclosed systems, methods, and/or apparatuses.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
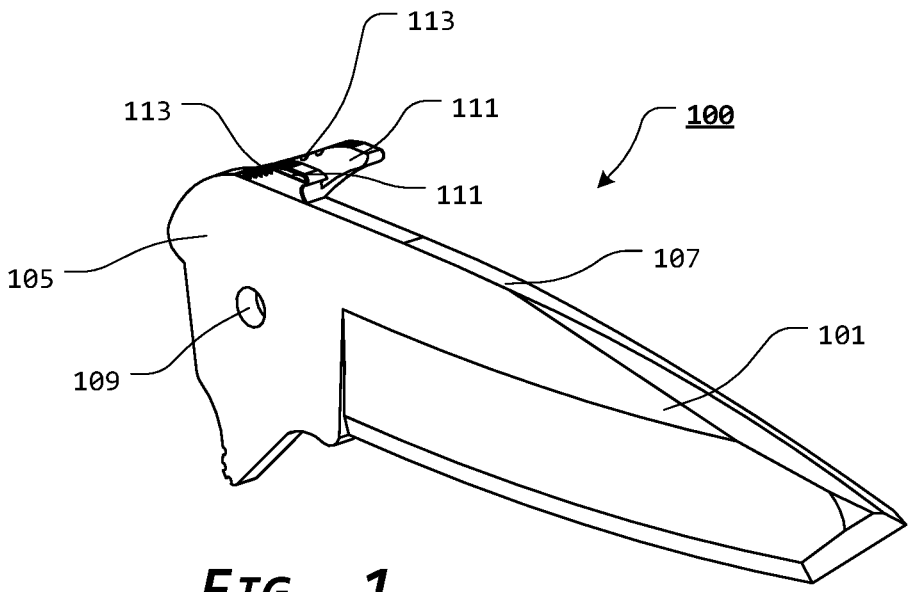
FIG. 1 illustrates an upper, front perspective view of an exemplary embodiment of an assisted opening knife blade, according to the presently disclosed systems, methods, and/or apparatuses.
Figure 2:
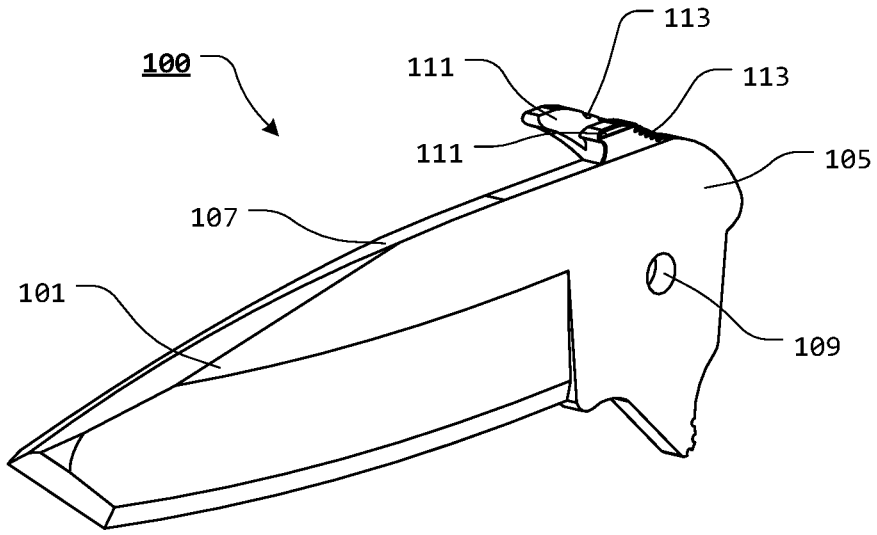
FIG. 2 illustrates an upper, front perspective view of an exemplary embodiment of an assisted opening knife blade, according to the presently disclosed systems, methods, and/or apparatuses.
Figure 3:
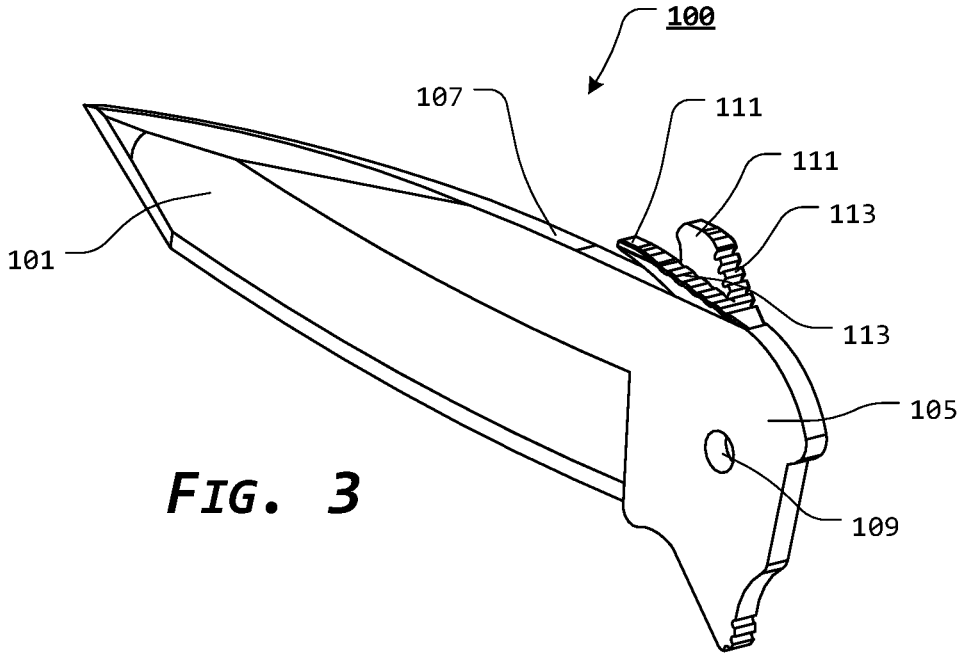
FIG. 3 illustrates an upper, rear perspective view of an exemplary embodiment of an assisted opening knife blade, according to the presently disclosed systems, methods, and/or apparatuses.
Figure 4:
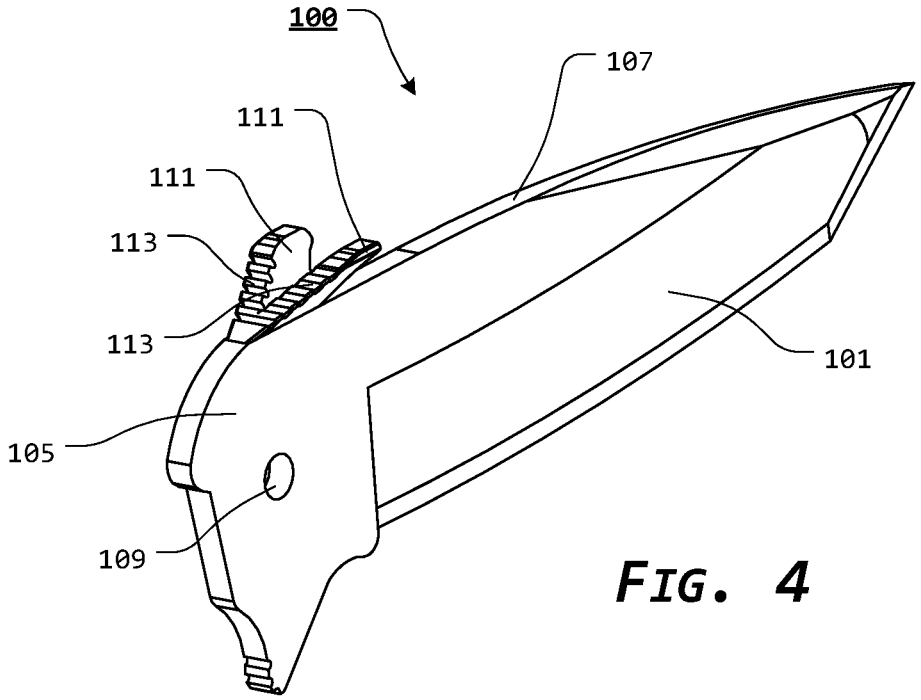
FIG. 4 illustrates an upper, rear perspective view of an exemplary embodiment of an assisted opening knife blade, according to the presently disclosed systems, methods, and/or apparatuses.
Figure 5:
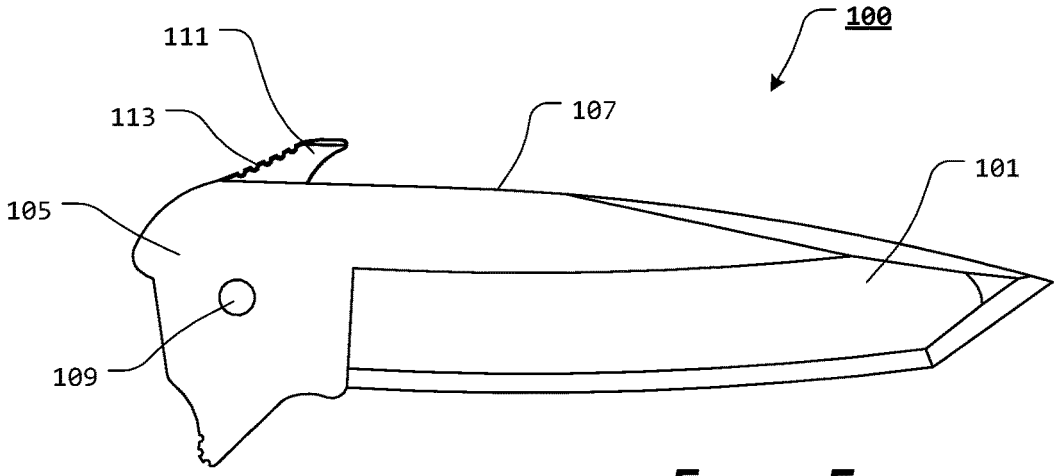
FIG. 5 illustrates a left side view of an exemplary embodiment of an assisted opening knife blade, according to the presently disclosed systems, methods, and/or apparatuses.
Figure 6:
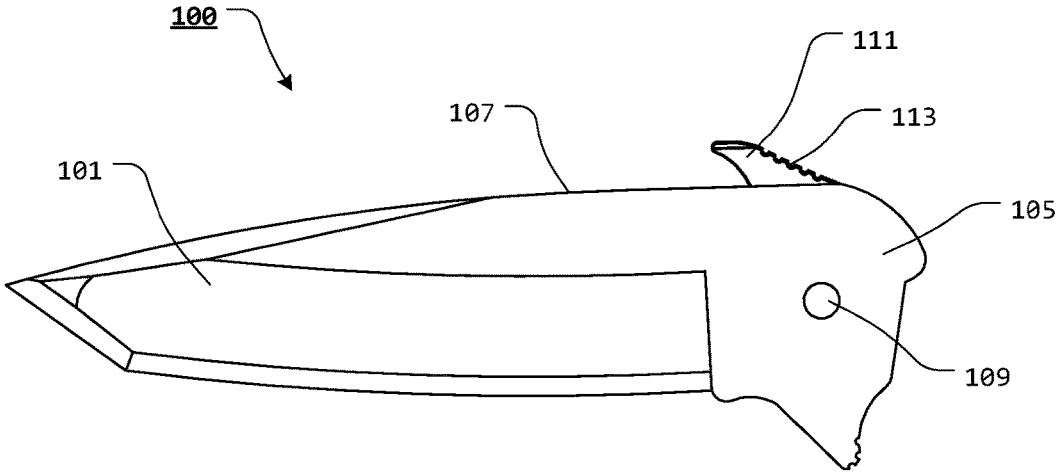
FIG. 6 illustrates a right side view of an exemplary embodiment of an assisted opening knife blade, according to the presently disclosed systems, methods, and/or apparatuses.
Figure 7:
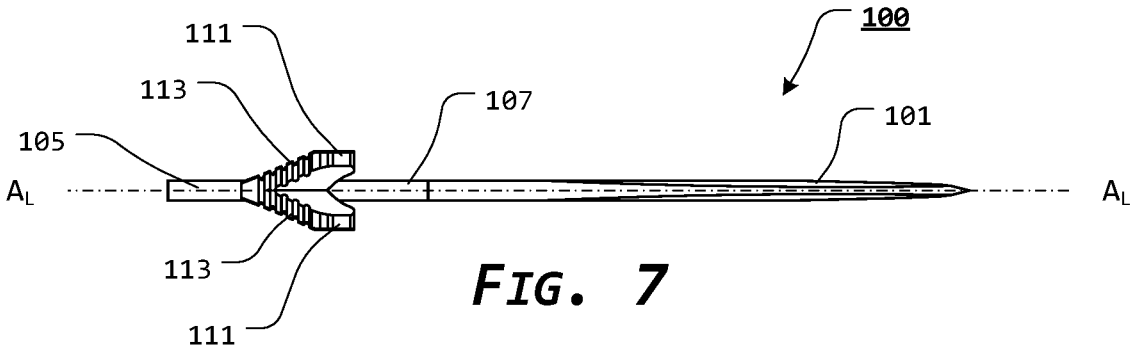
FIG. 7 illustrates a top view of an exemplary embodiment of an assisted opening knife blade, according to the presently disclosed systems, methods, and/or apparatuses.
Figure 8:
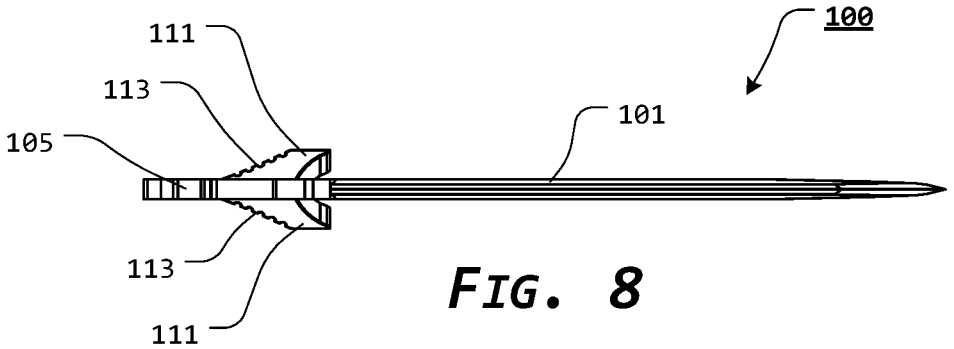
FIG. 8 illustrates a bottom view of an exemplary embodiment of an assisted opening knife blade, according to the presently disclosed systems, methods, and/or apparatuses.

For simplicity and clarification, the design factors and operating principles of the assisted opening knife blade according to the presently disclosed systems, methods, and/or apparatuses are explained with reference to various exemplary embodiments of an assisted opening knife blade according to the presently disclosed systems, methods, and/or apparatuses. The basic explanation of the design factors and operating principles of the assisted opening knife blade is applicable for the understanding, design, and operation of the assisted opening knife blade of the presently disclosed systems, methods, and/or apparatuses. It should be appreciated that the assisted opening knife blade can be adapted to many applications where an assisted opening knife blade can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "assisted opening knife blade", "knife blade", "knife", and "blade projection" are used for basic explanation and understanding of the operation of the systems, methods, and apparatuses of the presently disclosed systems, methods, and/or apparatuses. Therefore, the terms "assisted opening knife blade", "knife blade", "knife", and "blade projection" are not to be construed as limiting the systems, methods, and apparatuses of the presently disclosed systems, methods, and/or apparatuses. For example, the term "knife" may refer to any manually operated or spring assist folding or pocketknife.

For simplicity and clarification, the assisted opening knife blade of the presently disclosed systems, methods, and/or apparatuses will be described as being used in conjunction with a spring assist folding knife. However, it should be appreciated that these are merely exemplary embodiments of the assisted opening knife blade and are not to be construed as limiting the presently disclosed systems, methods, and/or apparatuses. Thus, the assisted opening knife blade of the presently disclosed systems, methods, and/or apparatuses may be utilized in connection with any spring assist or manually operated folding knife.

Figure 67:
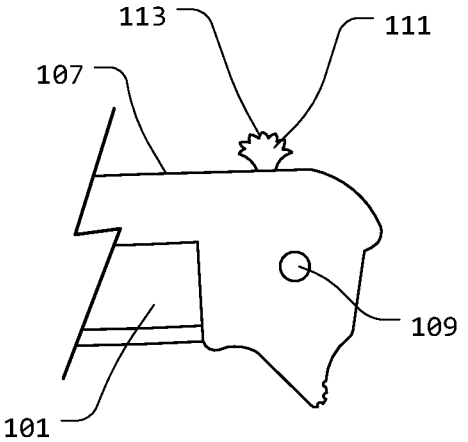
FIG. 67 illustrates partial, side view of certain exemplary components of an exemplary embodiment of an assisted opening knife blade, according to the presently disclosed systems, methods, and/or apparatuses.

Turning now to the appended drawing FIGS., FIGS. 1-67 illustrate certain elements and/or aspects of certain illustrative, non-limiting embodiment(s) of the presently disclosed systems, methods, and/or apparatuses of an assisted opening knife blade 100. As illustrated in FIGS. 1-67, the assisted opening knife blade 100 comprises at least some of a knife blade 101 having two or more blade projections 111 extending from the knife blade 101, proximate a pivot point (typically pivot aperture 109) of the knife blade 101.

In certain exemplary embodiments, knife blade 101 extends, along a longitudinal axis, $A_L$, from a tang 105 to a tip. The blade extends perpendicular to the longitudinal axis, $A_L$, from a spine 107 to an edge. A sagittal plane, $P_S$, is formed perpendicular to the longitudinal axis, $A_L$, generally separating the knife blade 101 into a left and right side, when viewed from the front or rear. In various exemplary embodiments, the sagittal plane, $P_S$, is formed along the midsagittal or median plane, exactly in the middle of the knife blade 101, passing through the tip of the knife blade 101.

The pivot aperture 109 is typically formed within a portion of the tang 105 and is formed so as to allow a pivot pin to be positioned therethrough. The pivot pin typically also extends through apertures formed through opposing sides of a knife handle. When assembled, the knife blade 101 is pivotable, via the pivot pin, between a closed (wherein at least a portion of the knife blade 101 is positioned within the blade recess) and an open position (wherein at least a portion of the knife blade 101 extends from a portion of the handle).

The knife blade 101 may optionally be fully manually articulated between the closed position and the open position or may be assisted by a spring or other portion element through at least a portion of the opening process.

In various exemplary embodiments, a spring assist element or torsion mechanism is included, which allows the blade to the manually pivoted to a point at which the spring or torsion mechanism engages the knife blade 101 and pivots the knife blade 101 toward the open position. Alternatively, the knife blade 101 may be used in conjunction with a manual, automatic, or switchblade style knife. Thus, it should be appreciated that the assisted opening knife blade 100 of the present disclosure can be utilized with any folding knife design.

It should be appreciated that a more detailed explanation of the components of a folding knife (whether manual or spring-assisted), instructions regarding how to open and close a folding knife, and certain other items and/or techniques necessary for the implementation and/or operation of the various components of the assisted opening knife blade 100 are not provided herein because such components are commercially available and/or such background information will be known to one of ordinary skill in the art. Therefore, it is believed that the level of description provided herein is sufficient to enable one of ordinary skill in the art to understand and utilize the assisted opening knife blade 100, as described.

As illustrated, for example, in FIGS. 1-10 the assisted opening knife blade 100 of the present disclosure comprises at least two blade projections 111 extending from the knife blade 101. Generally, the blade projections 111 extend from the spine 107 of the knife blade 101, proximate the pivot point of the knife blade 101. In various exemplary embodiments, each blade projection 111 is an integral extension of the knife blade 101. Alternatively, each blade projection 111 is attached or coupled, for example, via welding, to the spine 107 portion of the knife blade 101.

Each blade projection 111 extends from the spine 107 of the blade to a proximal or terminal end portion of the blade projection 111. Each blade projection 111 extends away from the sagittal plane, $P_S$, of the knife blade 101, such that the terminal end portion of each blade projection 111 extends beyond a plane formed by a side surface of the knife blade 101 or beyond the furthest extent away from the sagittal plane, $P_S$, of the knife blade 101.

In various exemplary embodiments, each blade projection 111 extends from the spine 107 of the blade, such that an angle, $\Theta$, formed between the sagittal plane, $P_S$, of the knife blade 101 or a substantially planar blade surface and a substantially planar outer blade projection 111 surface of one of the blade projections 111 is less than 180°.

In various exemplary embodiments, the angle, e, is about 135°, alternatively, the angle, $\Theta$, may be between about 165° and about 115°.

In various exemplary embodiments, the blade projections 111 extend from the spine 107, away from one another, such that an angle, $\Theta_2$, is formed between the blade projections 111. Generally, the angle, $\Theta_2$, is an acute angle, being less than 90°. Alternatively, the angle, $\Theta_2$, may optionally be an obtuse angle, being greater than 90°.

Figure 9:
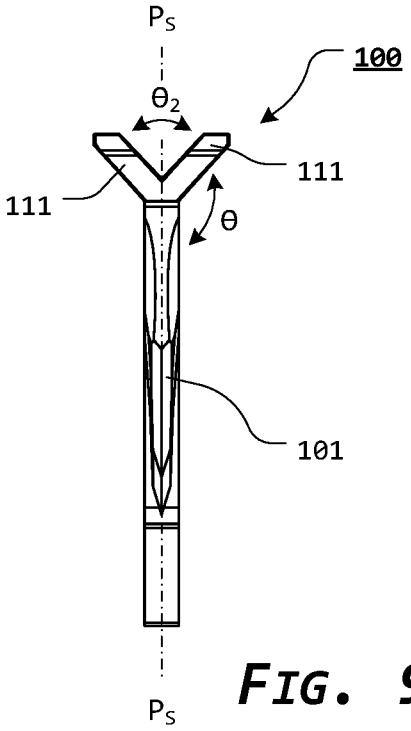
FIG. 9 illustrates a front view of an exemplary embodiment of an assisted opening knife blade, according to the presently disclosed systems, methods, and/or apparatuses.
Figure 10:
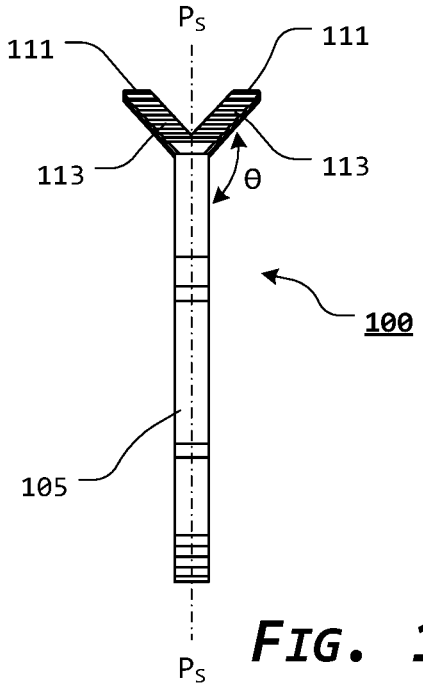
FIG. 10 illustrates a rear view of an exemplary embodiment of an assisted opening knife blade, according to the presently disclosed systems, methods, and/or apparatuses.

Thus, the blade projections 111 generally extend to form a "V" shape, when viewed from the front of the knife blade 101 (as illustrated most clearly in FIGS. 9-10).

In certain exemplary embodiments, the blade projections 111 extend from the spine 107 of the knife blade 101 in a curved or arcuate fashion, as the blade projections 111 extend toward the tip of the knife blade 101. The curved or arcuate shape of the blade projections 111 provide a point or area more easily engages or temporarily grabs the surface of a pocket or carrier within which the knife is carried. When the knife is withdrawn from the pocket or carrier, the curved or arcuate shape of the blade projections 111 allow the blade projections 111 to more easily catch or grab on the material forming the carrier.

One or more surfaces of the blade projections 111 include a textured portion 113. The textured portion 113 may be formed on an outward facing surface or surface portion of the blade projection 111 or along an outward facing or inward facing spine or terminal edge of the blade projection 111. If included, the textured portion 113 may optionally comprise an area or surface of the blade projections 111 that is notched, serrated, or otherwise textured so as to be distinguished tactilely from other portions of the blade projections 111. The textured portions 113 provide for increased frictional engagement between the blade projections 111 and the surface of a pocket or carrier within which the knife is carried. When the knife is withdrawn from the pocket or carrier, the textured portions 113 allow the blade projections 111 to more easily catch or grab on the material forming the carrier.

In certain exemplary, nonlimiting embodiments, the textured portions 113 of the blade projections 111 may comprise a series of cuts or notches to define a plurality of projections or teeth extending from at least a portion of each blade projection 111. It should be appreciated that the shape and degree of aggressiveness of the textured portions 113 is a design choice based upon the desired level of frictional engagement between the textured portions 113 and a material that the textured portions 113 of the blade projection 111 contacts.

In various exemplary embodiments, the blade projections 111 may be formed as an integral portion of the knife blade 101 that may be formed by splitting or dividing a portion of the knife blade 101 prior to heat treating the knife blade 101.

The divided portions of the knife blade 101 can then be urged or bent away from one another to form the angled blade projections 111. Once properly formed, the knife blade 101 may be heat-treated or otherwise hardened in order to maintain the relative position of the blade projections 111.

During use of a knife incorporating the assisted opening knife blade 100 of the present disclosure, the knife is typically initially presented in the closed position. In the closed position, the knife is inserted within a pocket, pouch, or other carrier. As the knife is inserted within the pocket, pouch, or carrier, the profile of the blade projections 111 allow the knife to be inserted without excessive or undue frictional engagement between the blade projections 111 and the material forming the opening of the pocket, pouch, or carrier. Once inserted, the knife can be maintained within the pocket, pouch, or carrier using known methods, such as, for example, a pocket clip.

As the user withdraws the knife from the pocket, pouch, or carrier, one or more of the blade projections 111 is urged against and creates frictional engagement with one or more interior surfaces or edge openings of the pocket, pouch, or carrier. As the knife continues to be withdrawn, the frictional engagement between the surfaces of the pocket, pouch, or carrier and one or more of the blade projections 111 begins to pivot the knife blade 101, via the pivot pin positioned through the pivot pin aperture 109, from the closed position, toward the open position. As the knife continues to be withdrawn, the engagement between the surfaces and the blade projections 111 continue to pivot the knife blade 101 toward the open position.

Particularly, but not exclusively, in the case of spring assist knives, the amount of rotational travel and/or the rotational force provided by the blade projections 111, allows the knife blade 101 to be pivoted to the open position, as the knife is fully withdrawn from the pocket, pouch, or carrier.

Thus, as the knife is withdrawn, leading edges or other portions of the blade projections 111 snag the inner lining of a pocket, pouch, or carrier and will cling in place as the motion of the withdrawal causes the knife blade 101 to pivot against that lining. It is also during this pivoting action that the blade projections 111 will lose their ability to snag the lining materials and release the lining as the knife blade 101 reaches its maximum rotation to the open position.

Because at least a portion of the blade projections 111 extend beyond one or both sides of the knife blade 101, the likelihood of frictional engagement between at least a portion of the blade projections 111 and the interior surface of the pocket, pouch, or carrier is increased.

Figure 11:
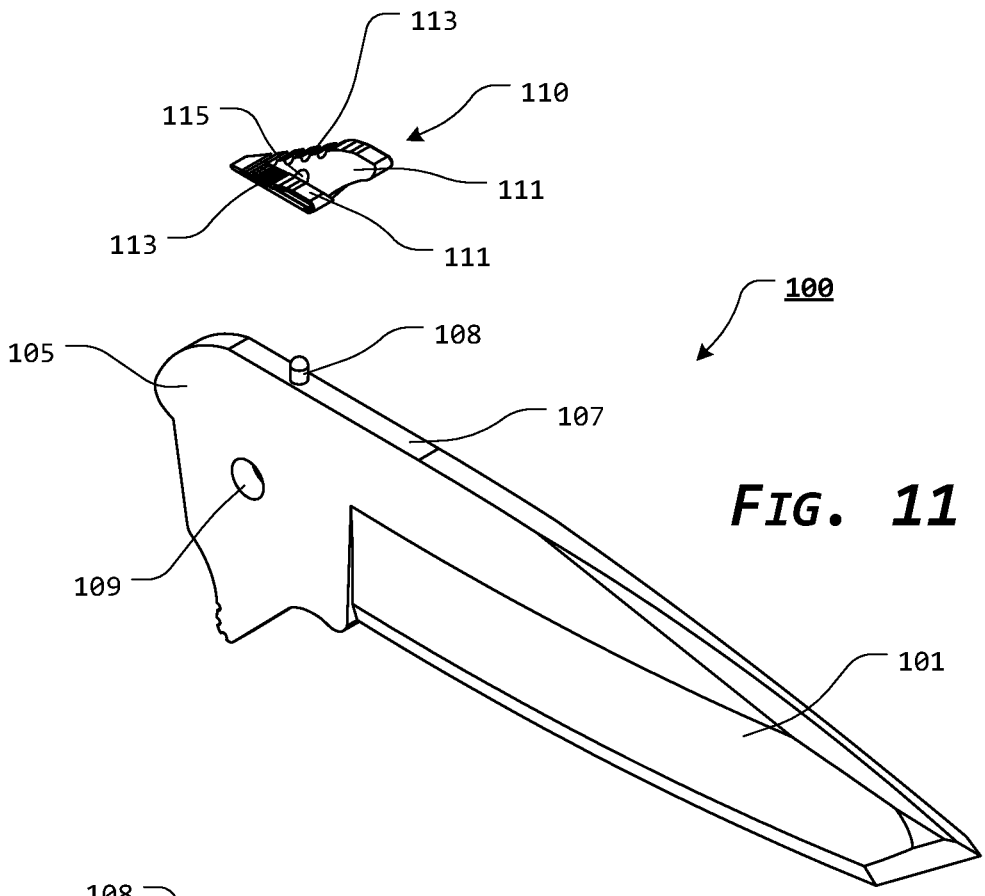
FIG. 11 illustrates an upper, front, exploded, perspective view of certain exemplary components of an exemplary embodiment of an assisted opening knife blade, according to the presently disclosed systems, methods, and/or apparatuses.

In various exemplary embodiments, as illustrated in FIG. 11 and following, the blade projections 111 may be portions of a blade projection module 110. The blade projection module 110 comprises a substantially "U" or "V" shaped portion of material, incorporating the blade projections 111, which can be attached or coupled to the spine 107 or other portions of the knife blade 101 to provide blade projections 111 to the knife blade 101.

Figure 12:
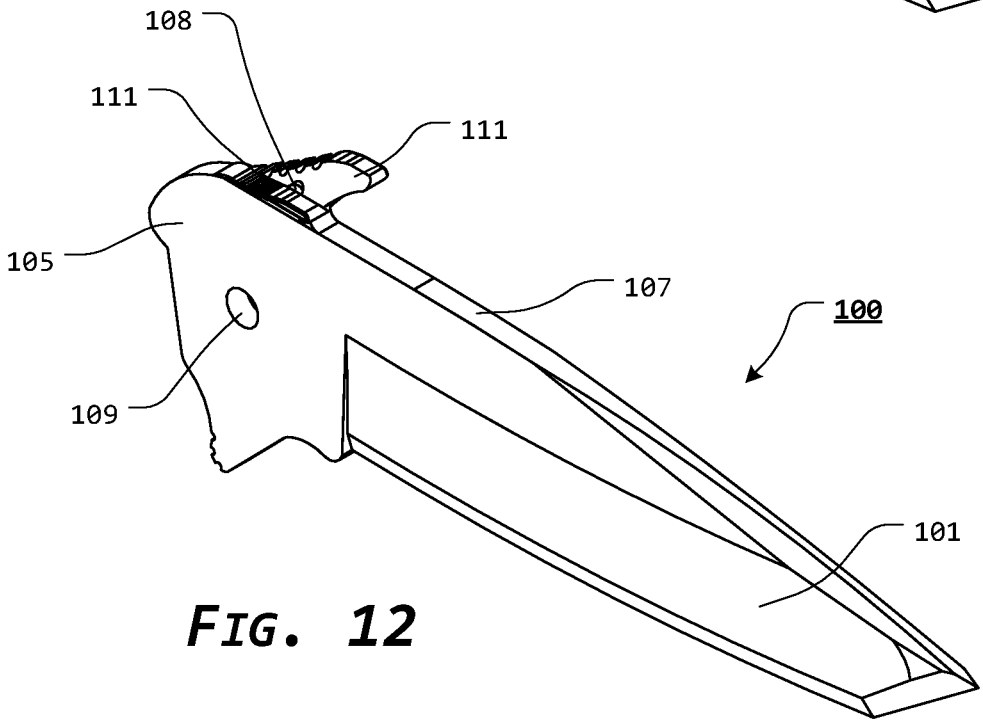
FIG. 12 illustrates an upper, front, perspective view of an exemplary embodiment of an assisted opening knife blade, according to the presently disclosed systems, methods, and/or apparatuses.

As illustrated in FIGS. 11 and 12, a securing aperture or fastener aperture 115 may be formed through the blade projection module 110, between the blade projections 111. The fastener aperture 115 may optionally include internal threading that is able to interact with external threading of a fastener, such as, for example, a fastener 120

A securing projection 108 may extend from the spine 107 to provide an alignment and securing projection that can be matingly received at least partially within the fastener aperture 115. Once appropriately positioned relative to the knife blade 101, as illustrated in FIG. 12, the blade projection module 110 may be attached or coupled, via tack or spot welding, epoxy, polymer, resin, epoxy, polymer, or other adhesive bonding, etc., to the spine 107 of the knife blade 101.

Figure 13:
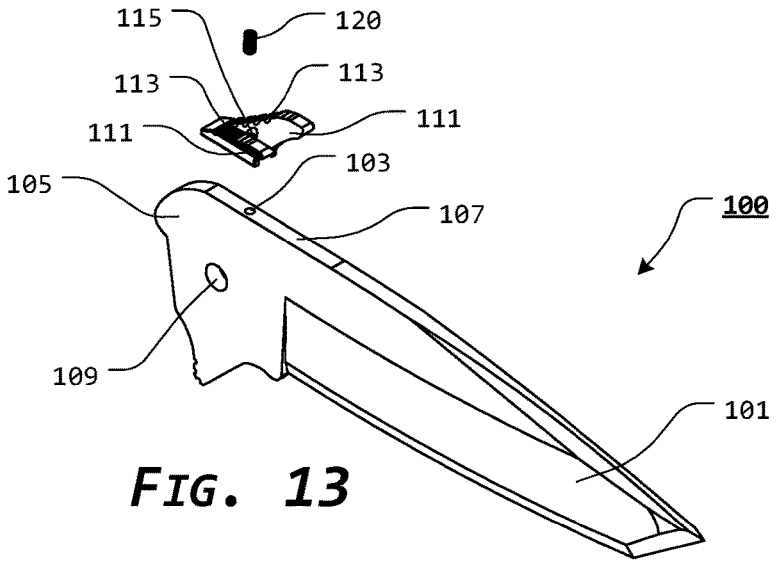
FIG. 13 illustrates an upper, front, exploded, perspective view of certain exemplary components of an exemplary embodiment of an assisted opening knife blade, according to the presently disclosed systems, methods, and/or apparatuses.
Figure 14:
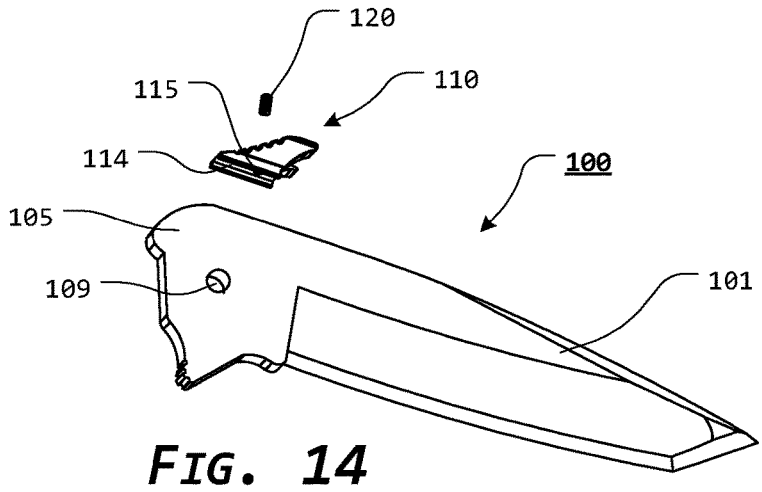
FIG. 14 illustrates a lower, rear, exploded, perspective view of certain exemplary components of an exemplary embodiment of an assisted opening knife blade, according to the presently disclosed systems, methods, and/or apparatuses.
Figure 15:
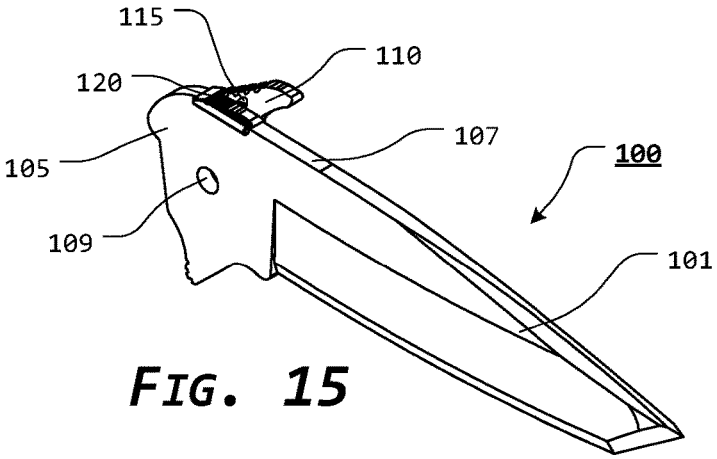
FIG. 15 illustrates an upper, front, perspective view of an exemplary embodiment of an assisted opening knife blade, according to the presently disclosed systems, methods, and/or apparatuses.

As illustrated in FIGS. 13-15, a fastener aperture 115 is formed through the apex of the blade projection module 110, between the blade projections 111. An at least partially internally threaded blade fastener recess 103 is formed through the spine 107 of the knife blade 101 and the blade projection module 110 may be attached or coupled to the knife blade 101 by aligning the fastener aperture 115 of the blade projection module 110 and the blade fastener recess 103 of the knife blade 101. Once properly aligned, a fastener 120, such as, for example, a cap screw or set screw, can be positioned at least partially through the fastener aperture 115 of the blade projection module 110 and threadedly secured within at least a portion of the blade fastener recess 103 of the knife blade 101.

As further illustrated in FIGS. 13-15, an alignment channel 114 may be formed in a portion of the blade projection module 110, generally opposite the blade projections 111. If included, the alignment channel 114 allows the blade projection module 110 to be appropriately aligned with a portion of the spine 107 of the knife blade 101. While potentially allowing for longitudinal movement (along the longitudinal axis) of the blade projection module 110 relative to the knife blade 101, the alignment channel 114 limits or prohibits lateral movement (side to side) of the blade projection module 110 relative to the knife blade 101.

Figure 16:
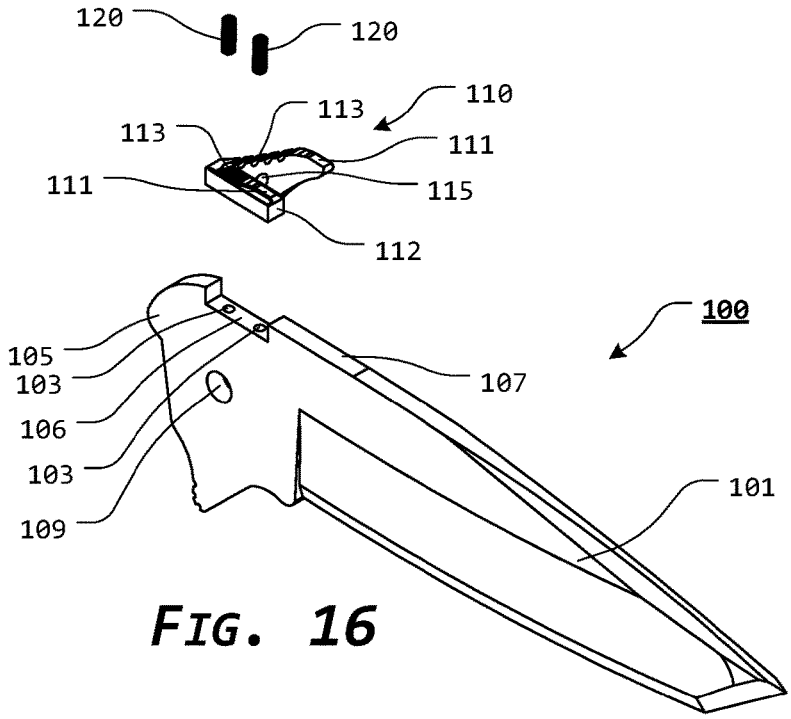
FIG. 16 illustrates an upper, front, exploded, perspective view of certain exemplary components of an exemplary embodiment of an assisted opening knife blade, according to the presently disclosed systems, methods, and/or apparatuses.
Figure 17:
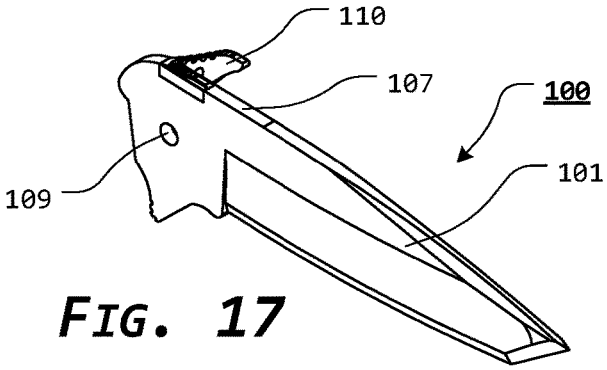
FIG. 17 illustrates an upper, front, perspective view of an exemplary embodiment of an assisted opening knife blade, according to the presently disclosed systems, methods, and/or apparatuses.
Figure 18:
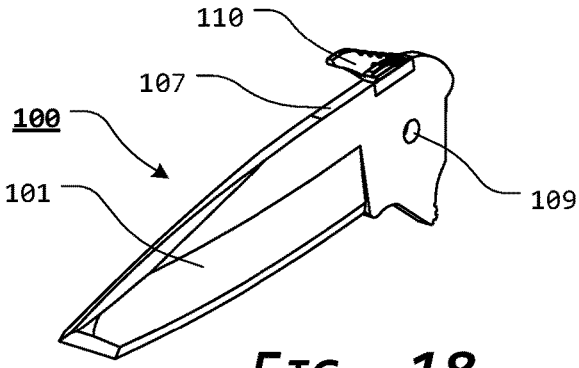
FIG. 18 illustrates an upper, front, perspective view of an exemplary embodiment of an assisted opening knife blade, according to the presently disclosed systems, methods, and/or apparatuses.
Figure 19:
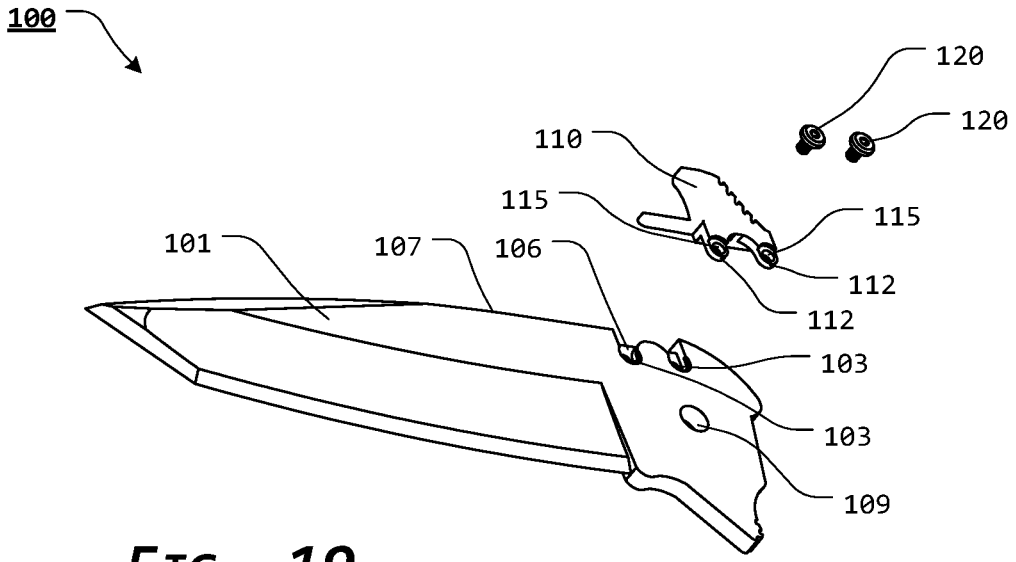
FIG. 19 illustrates a lower, front, exploded, perspective view of certain exemplary components of an exemplary embodiment of an assisted opening knife blade, according to the presently disclosed systems, methods, and/or apparatuses.
Figure 20:
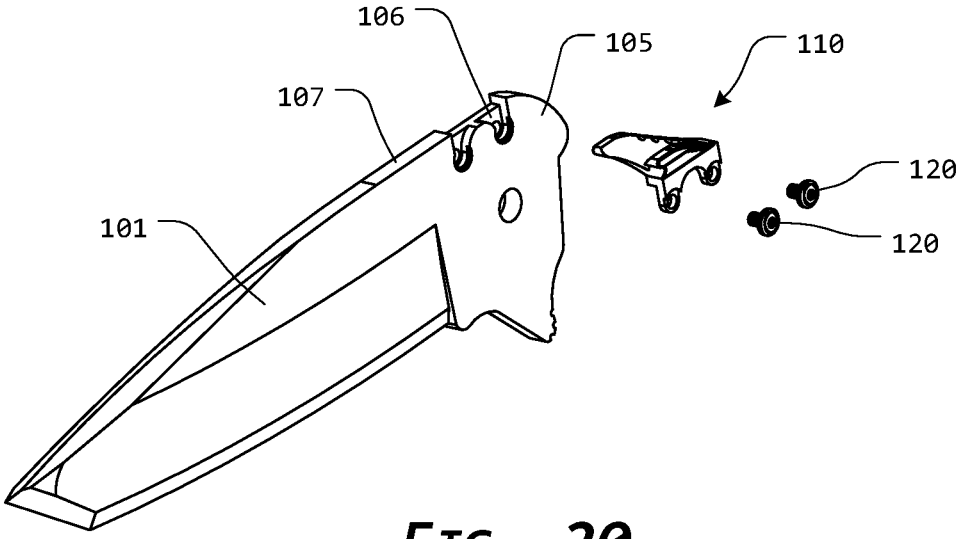
FIG. 20 illustrates an upper, front, exploded, perspective view of certain exemplary components of an exemplary embodiment of an assisted opening knife blade, according to the presently disclosed systems, methods, and/or apparatuses.
Figure 21:
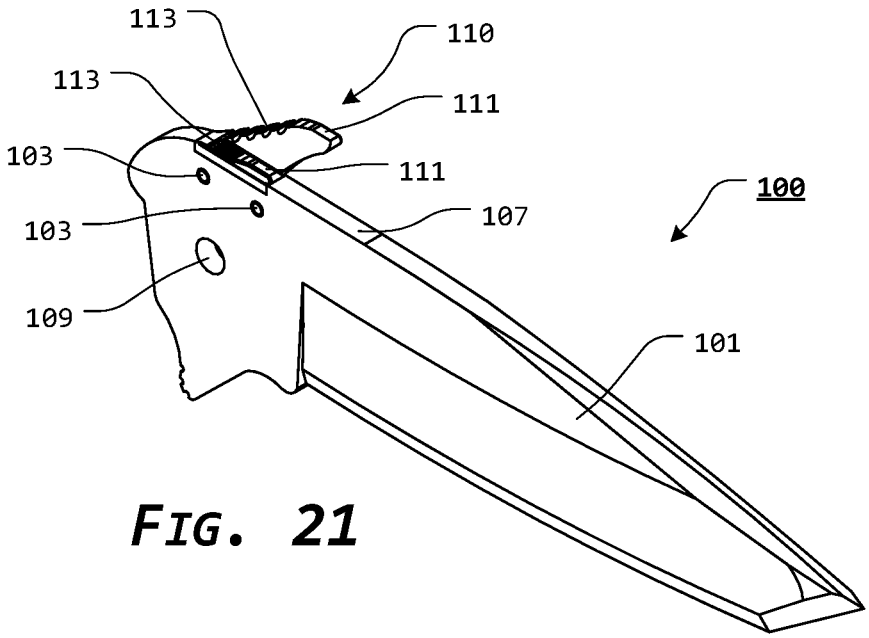
FIG. 21 illustrates an upper, front, perspective view of an exemplary embodiment of an assisted opening knife blade, according to the presently disclosed systems, methods, and/or apparatuses.
Figure 22:
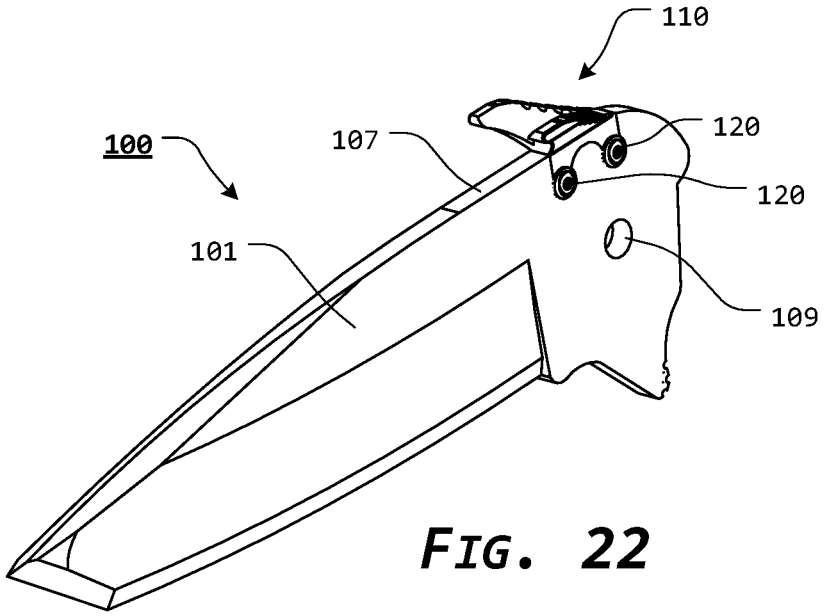
FIG. 22 illustrates an upper, front, perspective view of an exemplary embodiment of an assisted opening knife blade, according to the presently disclosed systems, methods, and/or apparatuses.

As illustrated in FIGS. 16-18, a blade projection module extension 112 may extend from the blade projection module 110, between and generally opposite the blade projections 111. A correspondingly shaped projection receiving recess 106 is formed in a portion of the spine 107.

One or more fastener apertures 115 are formed through the apex of the blade projection module 110, between the blade projections 111, so as to extend through the blade projection module extension 112. Corresponding at least partially internally threaded blade fastener recesses 103 are formed through the spine 107 of the knife blade 101, within the projection receiving recess 106.

As the blade projection module 110 is aligned with the knife blade 101, the blade projection module extension 112 is at least partially positioned within a portion of the projection receiving recess 106. In this manner, each of the fastener apertures 115 is aligned with a corresponding blade fastener recess 103. Once appropriately aligned, a fastener 120, such as, for example, a cap screw or set screw, can be positioned at least partially through a fastener aperture 115 of the blade projection module 110 and threadedly secured within at least a portion of a corresponding blade fastener recess 103 of the knife blade 101.

Interaction of the blade projection module extension 112 and the projection receiving recess 106 allows the blade projection module 110 to be appropriately aligned with a portion of the spine 107 of the knife blade 101. While potentially allowing for lateral movement of the blade projection module 110 relative to the knife blade 101, interaction of the blade projection module extension 112 and the projection receiving recess 106 limits or prohibits longitudinal movement of the blade projection module 110 relative to the knife blade 101.

As illustrated in FIGS. 19-22, the projection receiving recess 106 is formed within a side of the knife blade 101. The corresponding blade projection module extension 112 is formed so as to allow the blade projection module 110 to be attached from the side of the knife blade 101. Once appropriately aligned, a fastener 120, such as, for example, a cap screw or set screw, can be positioned at least partially through a fastener aperture 115 of the blade projection module 110 and threadedly secured within at least a portion of a corresponding blade fastener recess 103 of the knife blade 101.

Figure 23:
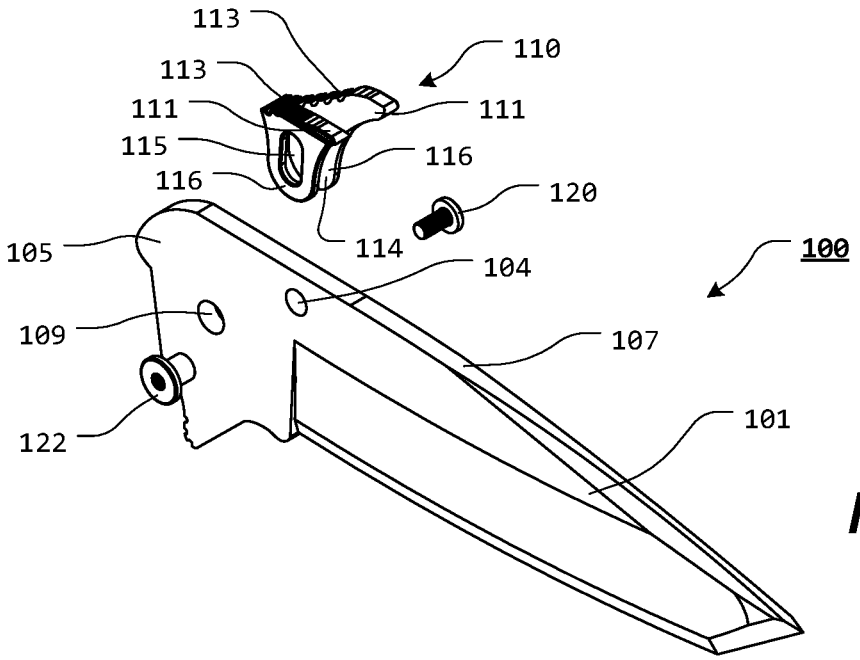
FIG. 23 illustrates an upper, front, exploded, perspective view of certain exemplary components of an exemplary embodiment of an assisted opening knife blade, according to the presently disclosed systems, methods, and/or apparatuses.
Figure 24:
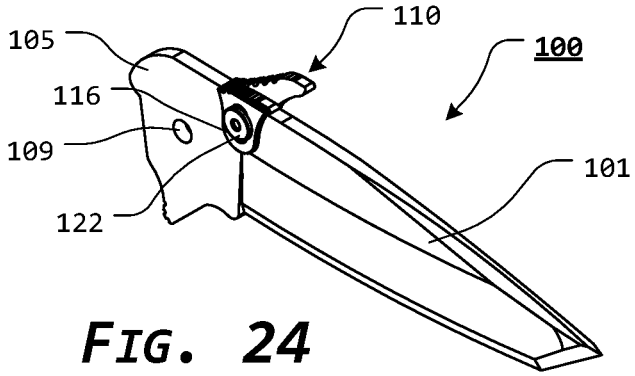
FIG. 24 illustrates an upper, front, perspective view of an exemplary embodiment of an assisted opening knife blade, according to the presently disclosed systems, methods, and/or apparatuses.
Figure 25:
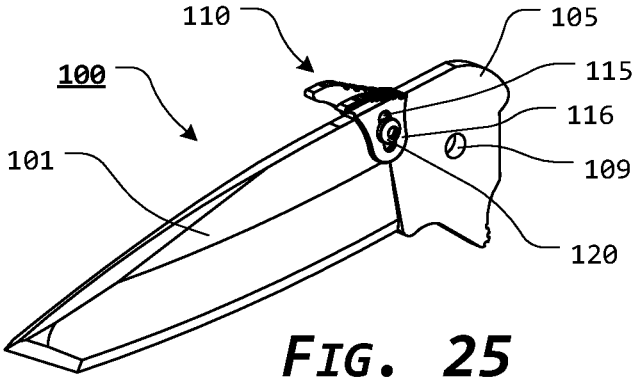
FIG. 25 illustrates an upper, front, perspective view of an exemplary embodiment of an assisted opening knife blade, according to the presently disclosed systems, methods, and/or apparatuses.
Figure 26:
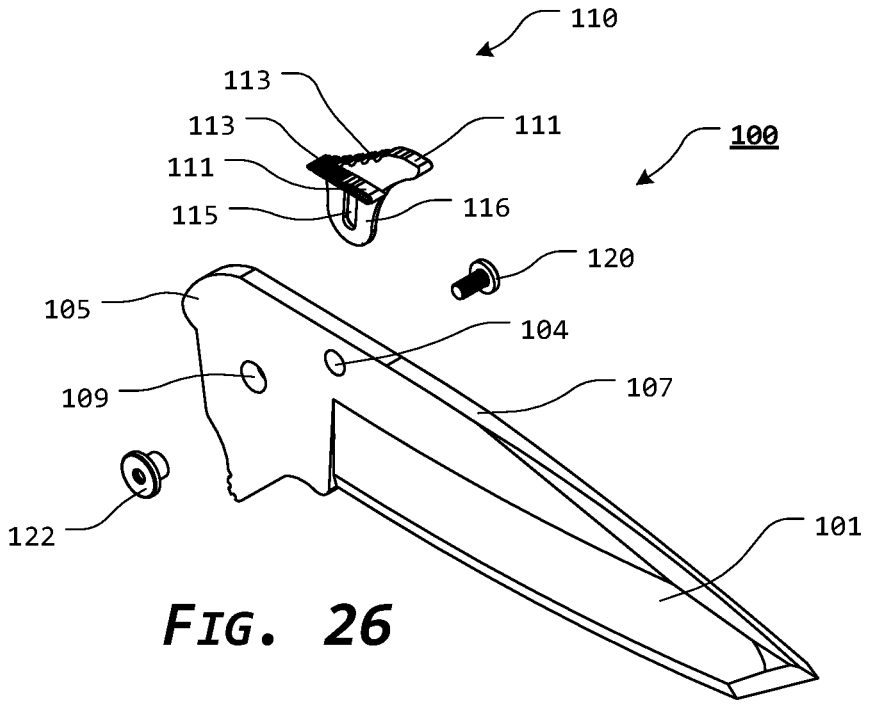
FIG. 26 illustrates an upper, front, exploded, perspective view of certain exemplary components of an exemplary embodiment of an assisted opening knife blade, according to the presently disclosed systems, methods, and/or apparatuses.
Figure 27:
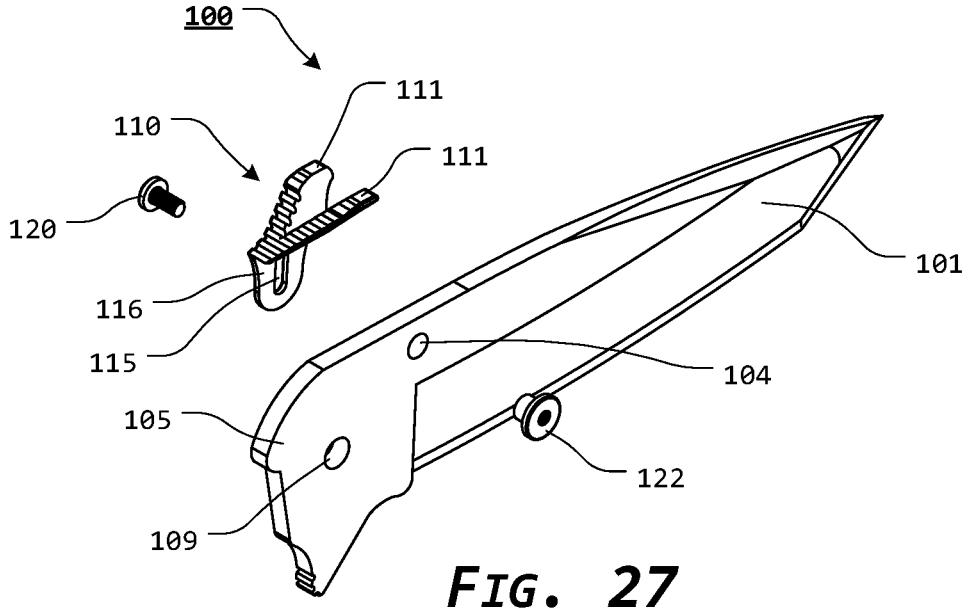
FIG. 27 illustrates an upper, rear, exploded, perspective view of certain exemplary components of an exemplary embodiment of an assisted opening knife blade, according to the presently disclosed systems, methods, and/or apparatuses.
Figure 28:
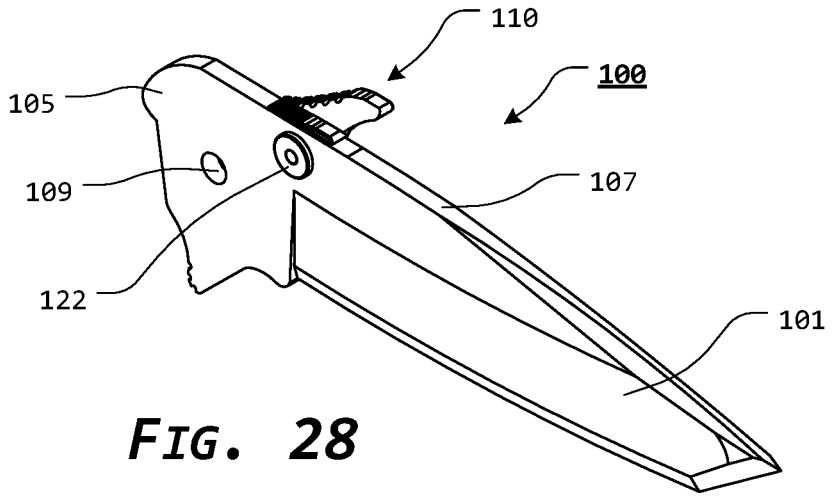
FIG. 28 illustrates an upper, front, perspective view of certain exemplary components of an exemplary embodiment of an assisted opening knife blade, according to the presently disclosed systems, methods, and/or apparatuses.
Figure 29:
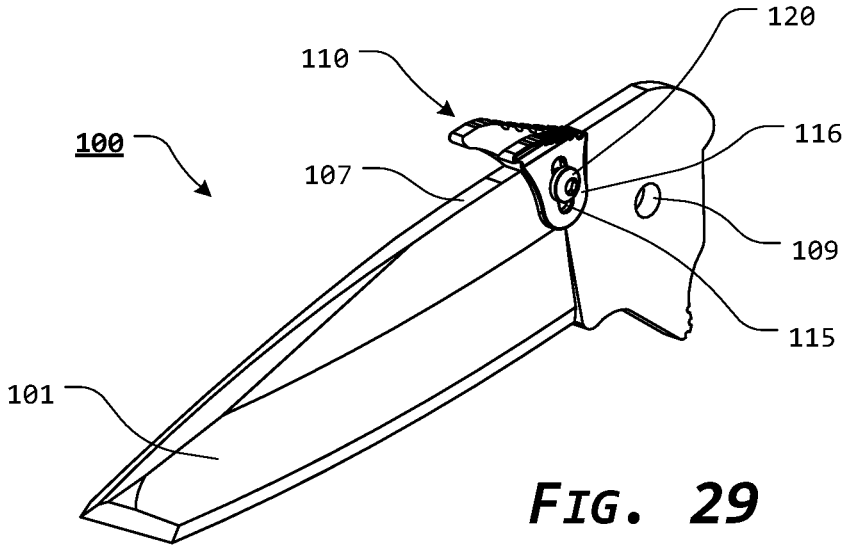
FIG. 29 illustrates an upper, front, perspective view of certain exemplary components of an exemplary embodiment of an assisted opening knife blade, according to the presently disclosed systems, methods, and/or apparatuses.
Figure 30:
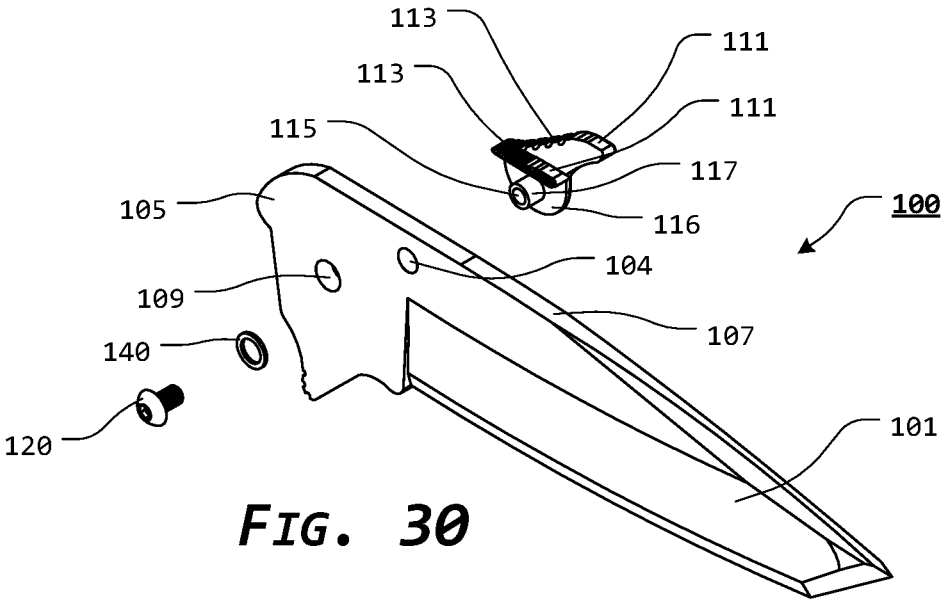
FIG. 30 illustrates an upper, front, exploded, perspective view of certain exemplary components of an exemplary embodiment of an assisted opening knife blade, according to the presently disclosed systems, methods, and/or apparatuses.
Figure 31:
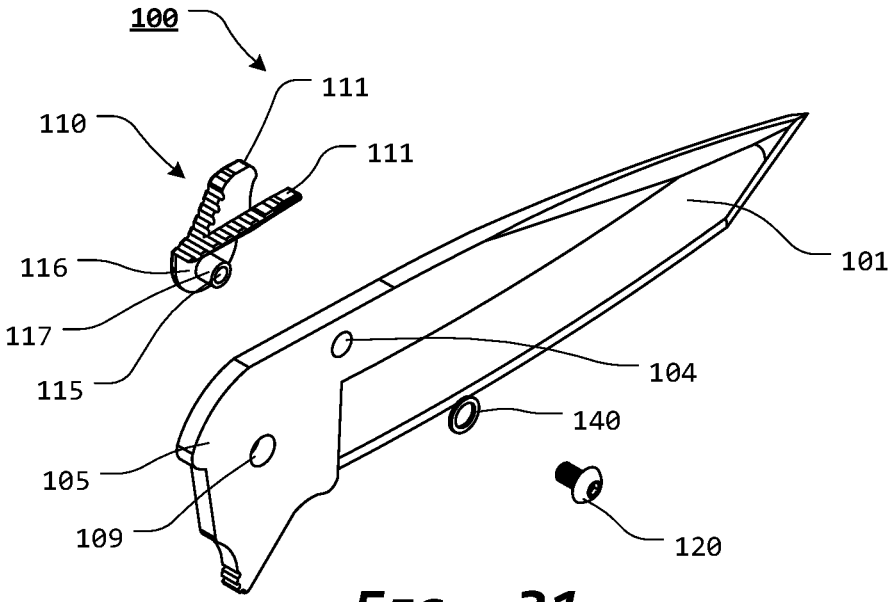
FIG. 31 illustrates an upper, rear, exploded, perspective view of certain exemplary components of an exemplary embodiment of an assisted opening knife blade, according to the presently disclosed systems, methods, and/or apparatuses.
Figure 32:
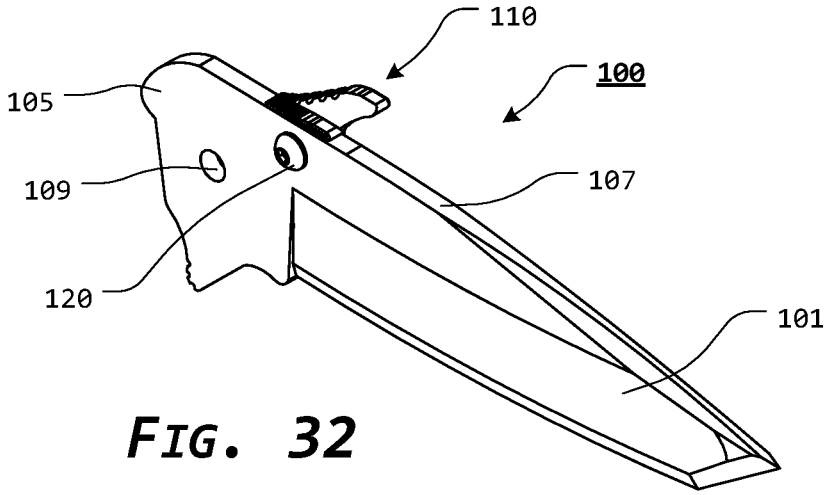
FIG. 32 illustrates an upper, front, perspective view of certain exemplary components of an exemplary embodiment of an assisted opening knife blade, according to the presently disclosed systems, methods, and/or apparatuses.
Figure 33:
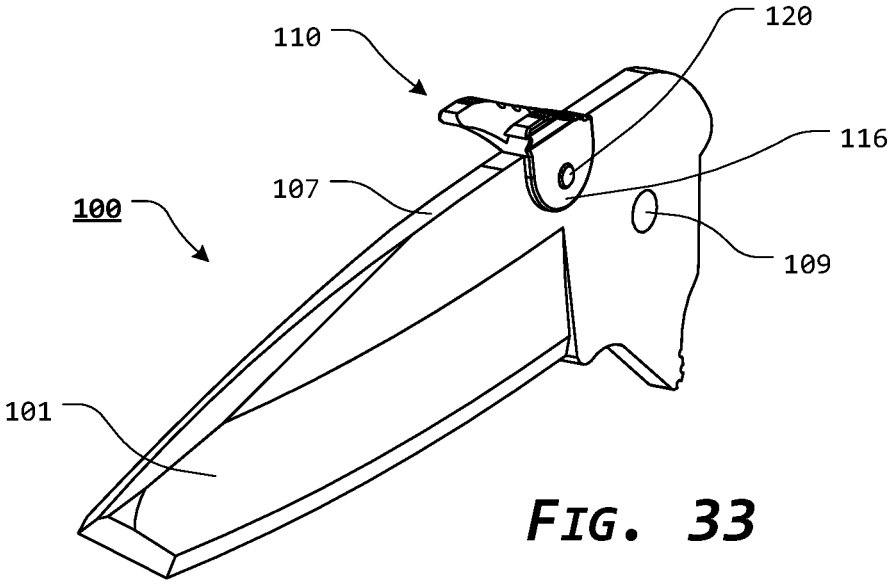
FIG. 33 illustrates an upper, front, perspective view of certain exemplary components of an exemplary embodiment of an assisted opening knife blade, according to the presently disclosed systems, methods, and/or apparatuses.

In various exemplary embodiments, as illustrated in FIGS. 23-25 and 26-29, the blade projection module 110 may include one or two projection extensions 116 extending from the blade projection module 110. The projection extension(s) 116 extend from the blade projection module 110 so as to be positionable adjacent at least a portion of the knife blade 101 surface. If two projection extensions 116 are included, as illustrated in FIGS. 23-25, an alignment channel 114 is formed between the two projection extensions 116. In these exemplary embodiments, a portion of the knife blade 101 is positionable within the alignment channel 114 so as to allow a projection extension 116 to extend adjacent at least a portion of each side of the knife blade 101 surface.

A fastener aperture 115 is formed through each of the included projection extensions 116. In certain exemplary embodiments, each fastener aperture 115 comprises one or more circular apertures. Alternatively, the fastener aperture 115 may comprise an elongate slot, allowing for positional movement of the blade projection module 110 relative to the knife blade 101.

A blade aperture 104 is formed through the knife blade 101 (substantially perpendicular to the longitudinal axis of the knife blade 101). As illustrated, the blade projection module 110 may be attached or coupled to the knife blade 101 by positioning a portion of the knife blade 101 within the alignment channel 114 and aligning the fastener aperture(s) 115 of the projection extensions 116 and a blade fastener recess 103 of the knife blade 101. Once properly aligned, a fastener 120, such as, for example, a cap screw or set screw, can be positioned at least partially through the fastener aperture 115 of one of the projection extensions 116 and threadedly secured to a nut or a flathead nut sleeve 122 position at least partially through the fastener aperture 115 of the other projection extension 116.

As illustrated in FIGS. 30-33, a securing projection 117 extends from a single projection extension 116, taking the place of the flathead nut sleeve 122. In this exemplary embodiment, the projection extension 116 is positioned through the blade aperture 104 and the externally threaded portion of the fastener 120 is threadedly inserted within at least a portion of the fastener aperture 115 formed at least partially through the securing projection 117, the securing the blade projection module 110 to the knife blade 101.

In certain exemplary embodiments, a washer 140 may optionally be positioned between a surface of the knife blade 101 and the head of the fastener 120.

Figure 34:
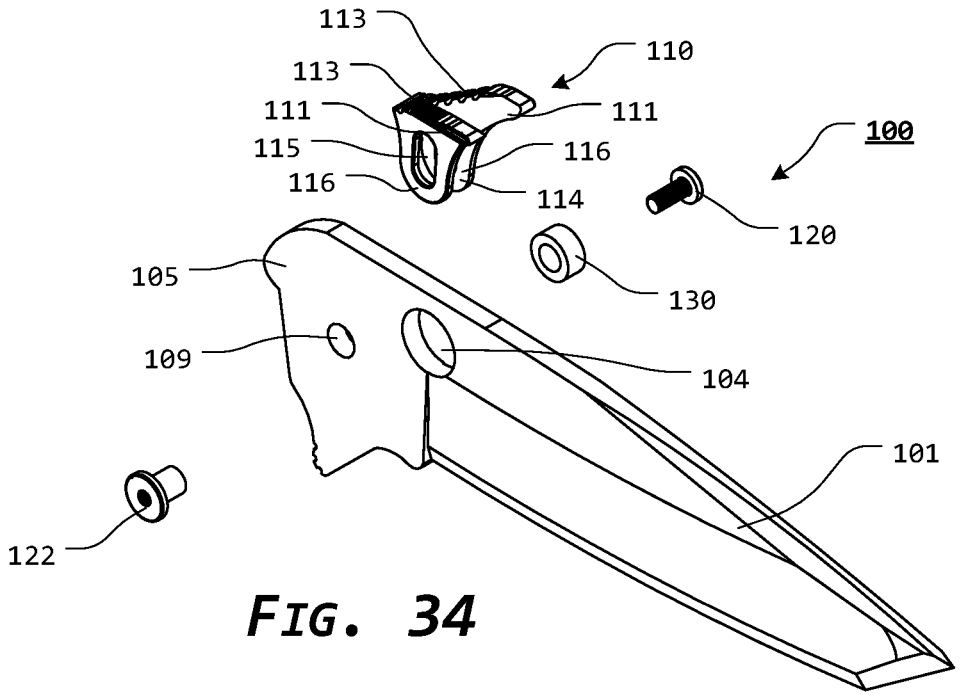
FIG. 34 illustrates an upper, front, exploded, perspective view of certain exemplary components of an exemplary embodiment of an assisted opening knife blade, according to the presently disclosed systems, methods, and/or apparatuses.
Figure 35:
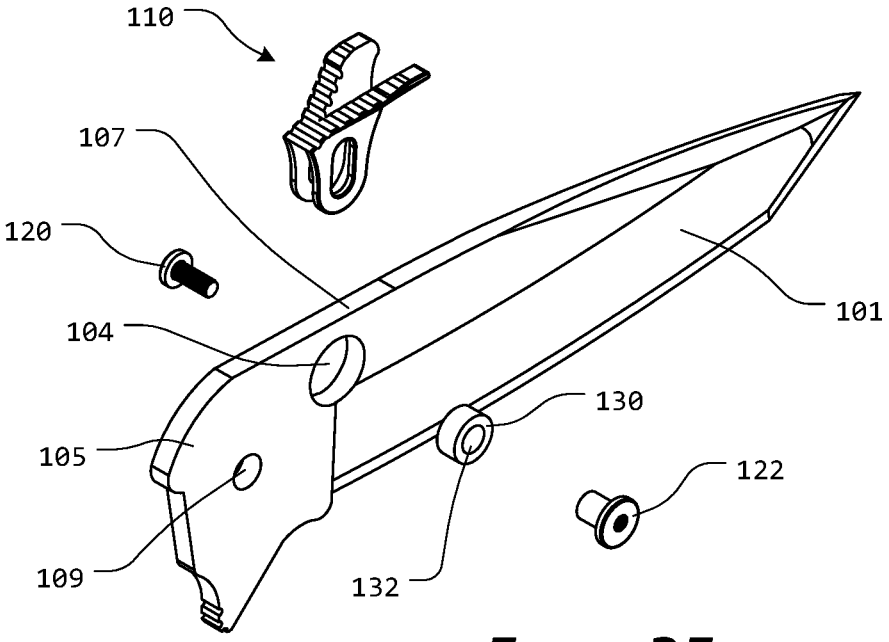
FIG. 35 illustrates an upper, rear, exploded, perspective view of certain exemplary components of an exemplary embodiment of an assisted opening knife blade, according to the presently disclosed systems, methods, and/or apparatuses.
Figure 36:
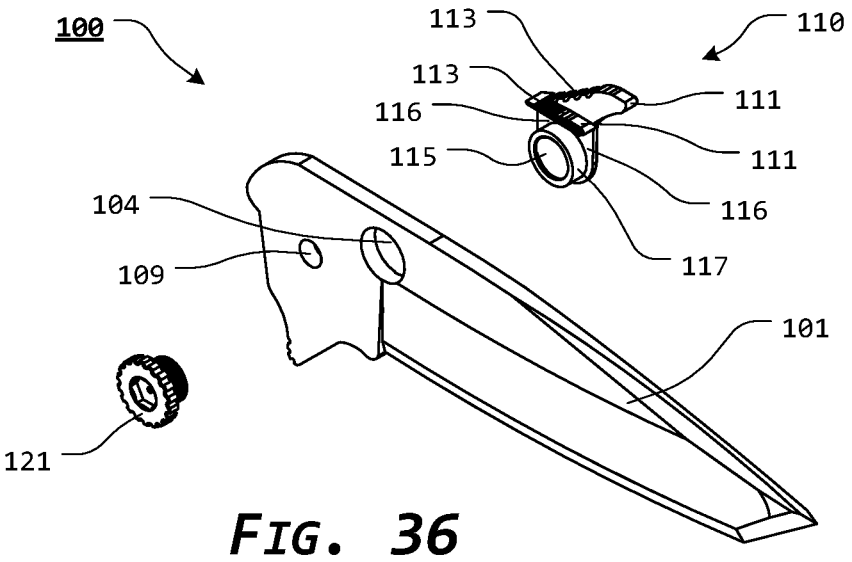
FIG. 36 illustrates an upper, front, exploded, perspective view of certain exemplary components of an exemplary embodiment of an assisted opening knife blade, according to the presently disclosed systems, methods, and/or apparatuses.
Figure 37:
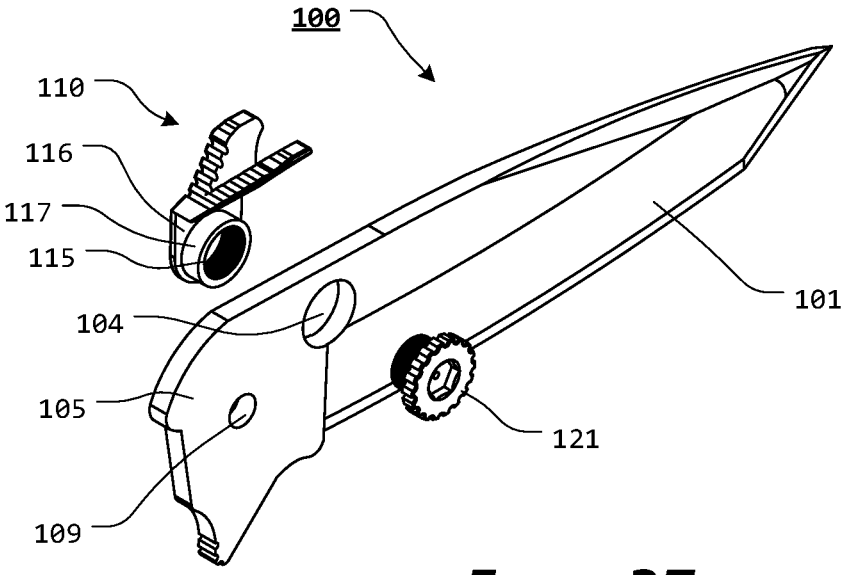
FIG. 37 illustrates an upper, rear, exploded, perspective view of certain exemplary components of an exemplary embodiment of an assisted opening knife blade, according to the presently disclosed systems, methods, and/or apparatuses.
Figure 38:
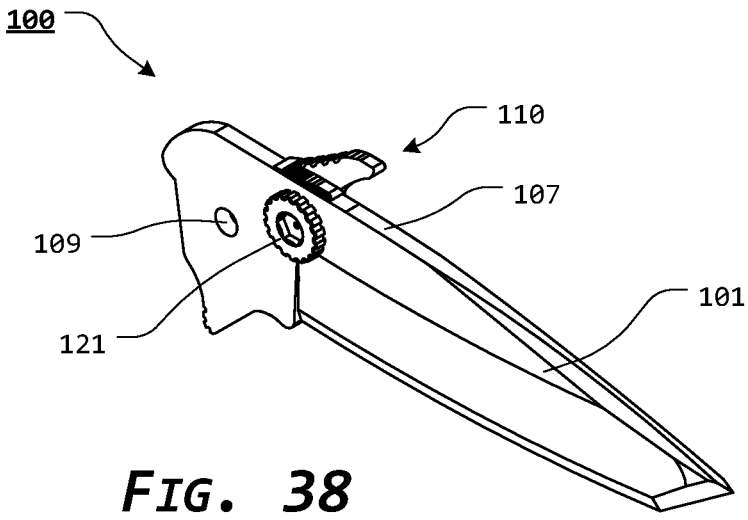
FIG. 38 illustrates an upper, front, perspective view of certain exemplary components of an exemplary embodiment of an assisted opening knife blade, according to the presently disclosed systems, methods, and/or apparatuses.
Figure 39:
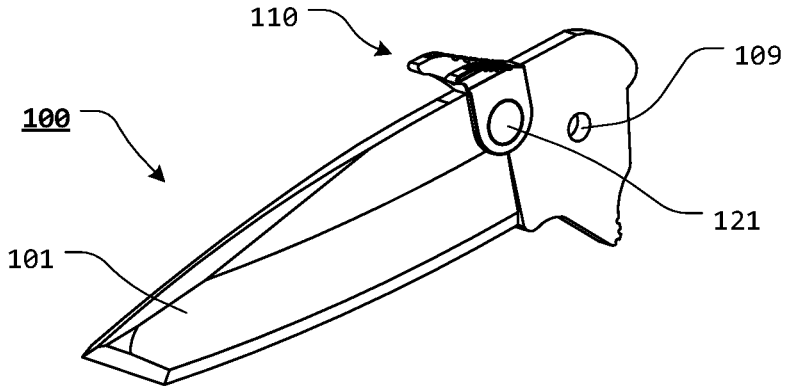
FIG. 39 illustrates an upper, front, perspective view of certain exemplary components of an exemplary embodiment of an assisted opening knife blade, according to the presently disclosed systems, methods, and/or apparatuses.
Figure 40:
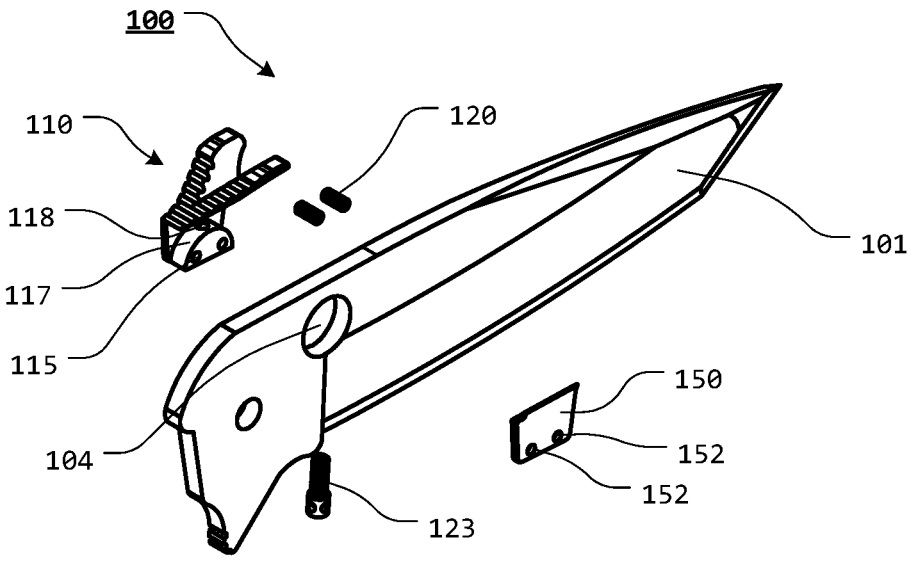
FIG. 40 illustrates an upper, front, exploded, perspective view of certain exemplary components of an exemplary embodiment of an assisted opening knife blade, according to the presently disclosed systems, methods, and/or apparatuses.
Figure 41:
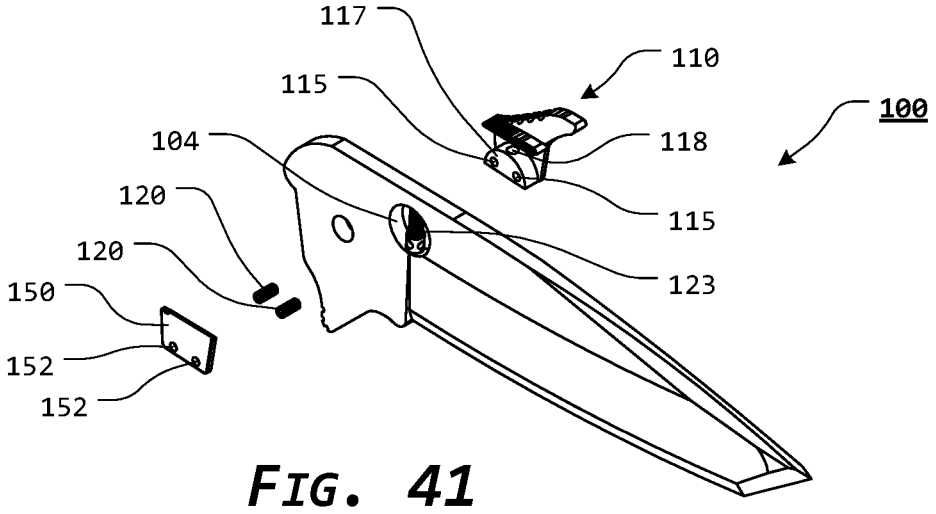
FIG. 41 illustrates an upper, rear, exploded, perspective view of certain exemplary components of an exemplary embodiment of an assisted opening knife blade, according to the presently disclosed systems, methods, and/or apparatuses.
Figure 42:
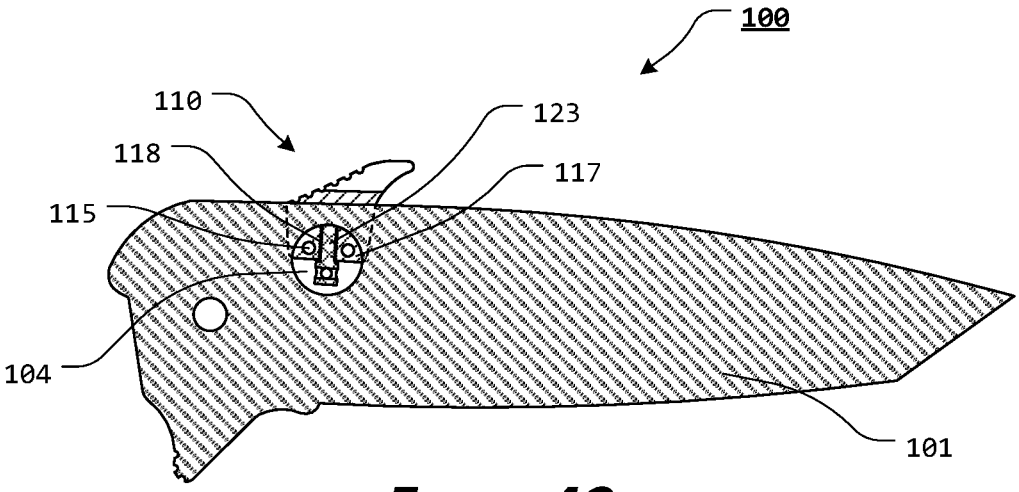
FIG. 42 illustrates a side, cross-sectional view of certain exemplary components of an exemplary embodiment of an assisted opening knife blade, according to the presently disclosed systems, methods, and/or apparatuses.
Figure 43:
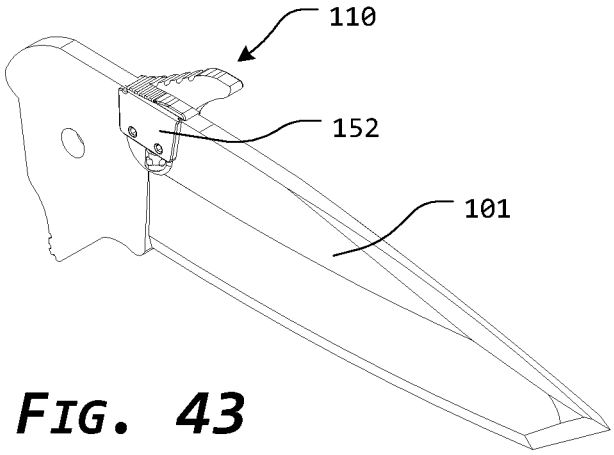
FIG. 43 illustrates an upper, front, perspective view of certain exemplary components of an exemplary embodiment of an assisted opening knife blade, according to the presently disclosed systems, methods, and/or apparatuses.
Figure 44:
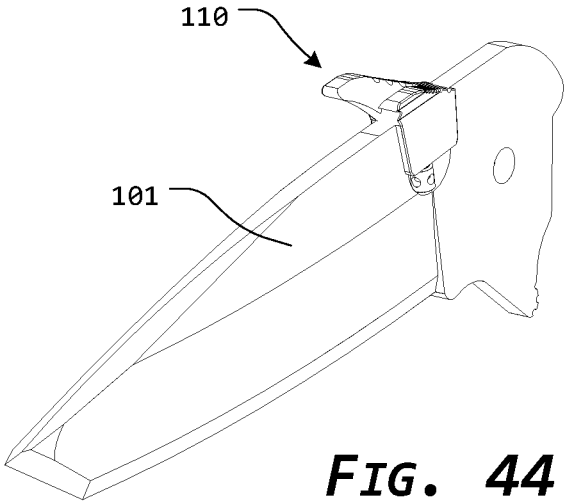
FIG. 44 illustrates an upper, front, perspective view of certain exemplary components of an exemplary embodiment of an assisted opening knife blade, according to the presently disclosed systems, methods, and/or apparatuses.
Figure 45:
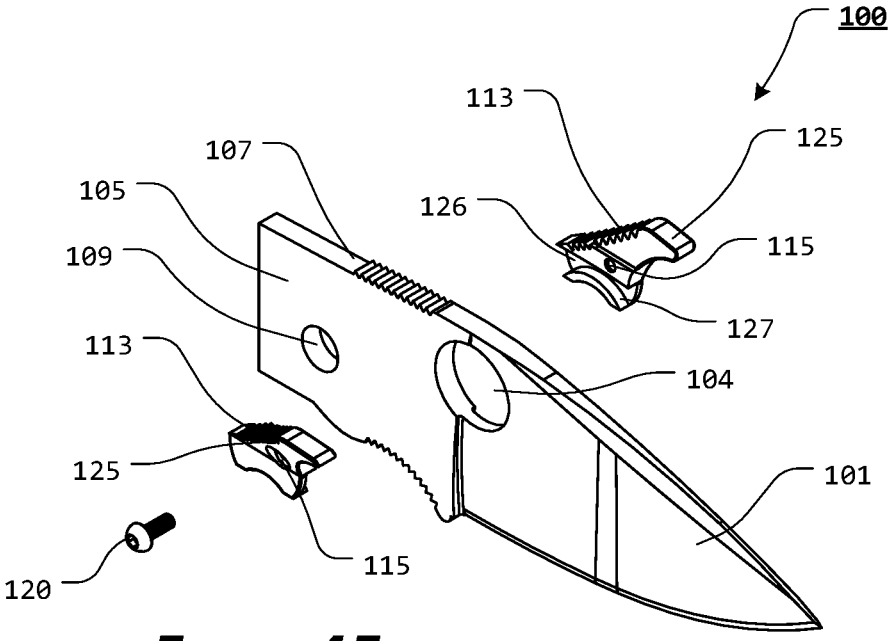
FIG. 45 illustrates an upper, front, exploded, perspective view of certain exemplary components of an exemplary embodiment of an assisted opening knife blade, according to the presently disclosed systems, methods, and/or apparatuses.
Figure 46:
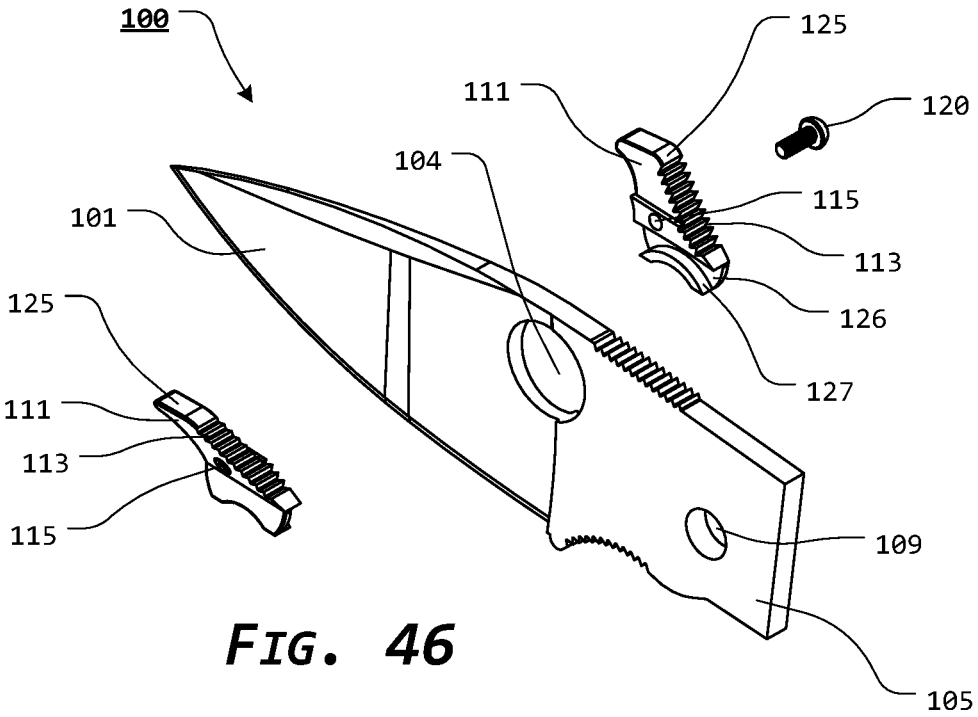
FIG. 46 illustrates an upper, rear, exploded, perspective view of certain exemplary components of an exemplary embodiment of an assisted opening knife blade, according to the presently disclosed systems, methods, and/or apparatuses.
Figure 47:
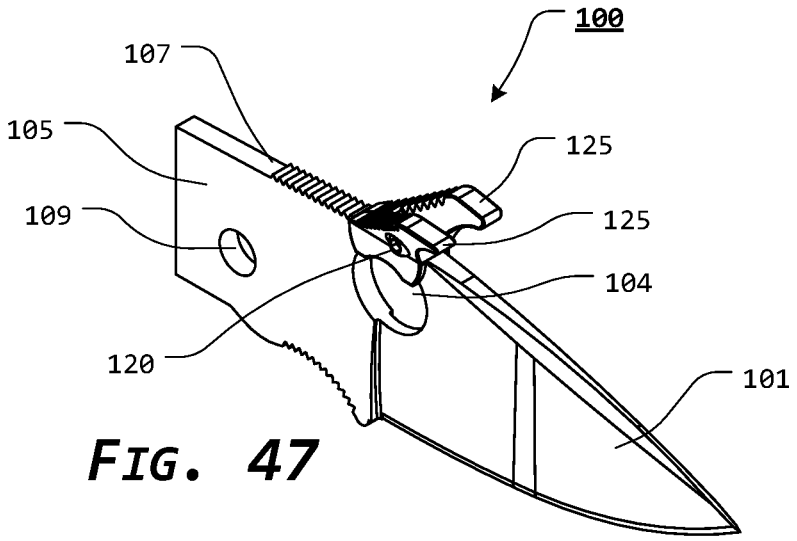
FIG. 47 illustrates an upper, front, perspective view of certain exemplary components of an exemplary embodiment of an assisted opening knife blade, according to the presently disclosed systems, methods, and/or apparatuses.
Figure 48:
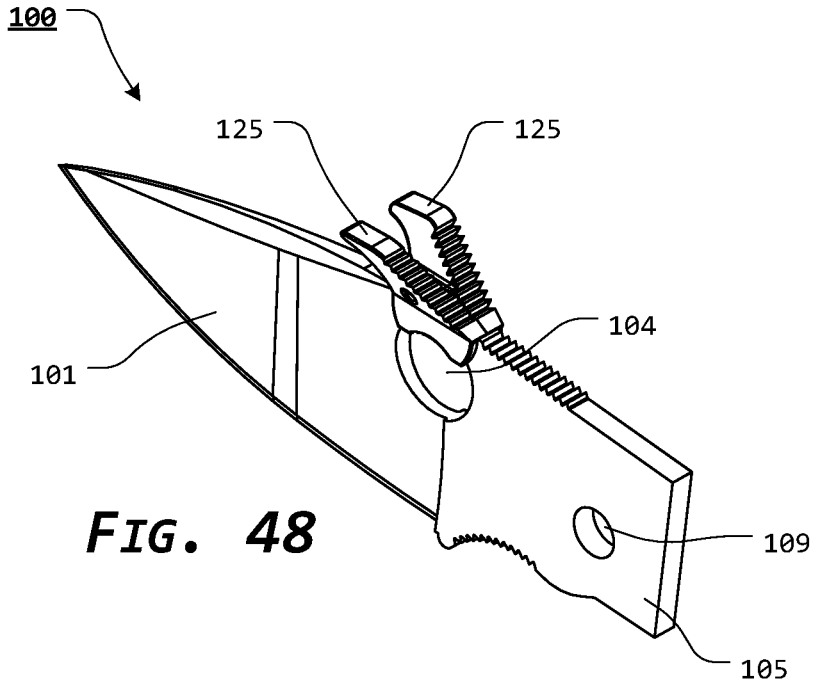
FIG. 48 illustrates an upper, rear, perspective view of certain exemplary components of an exemplary embodiment of an assisted opening knife blade, according to the presently disclosed systems, methods, and/or apparatuses.
Figure 49:
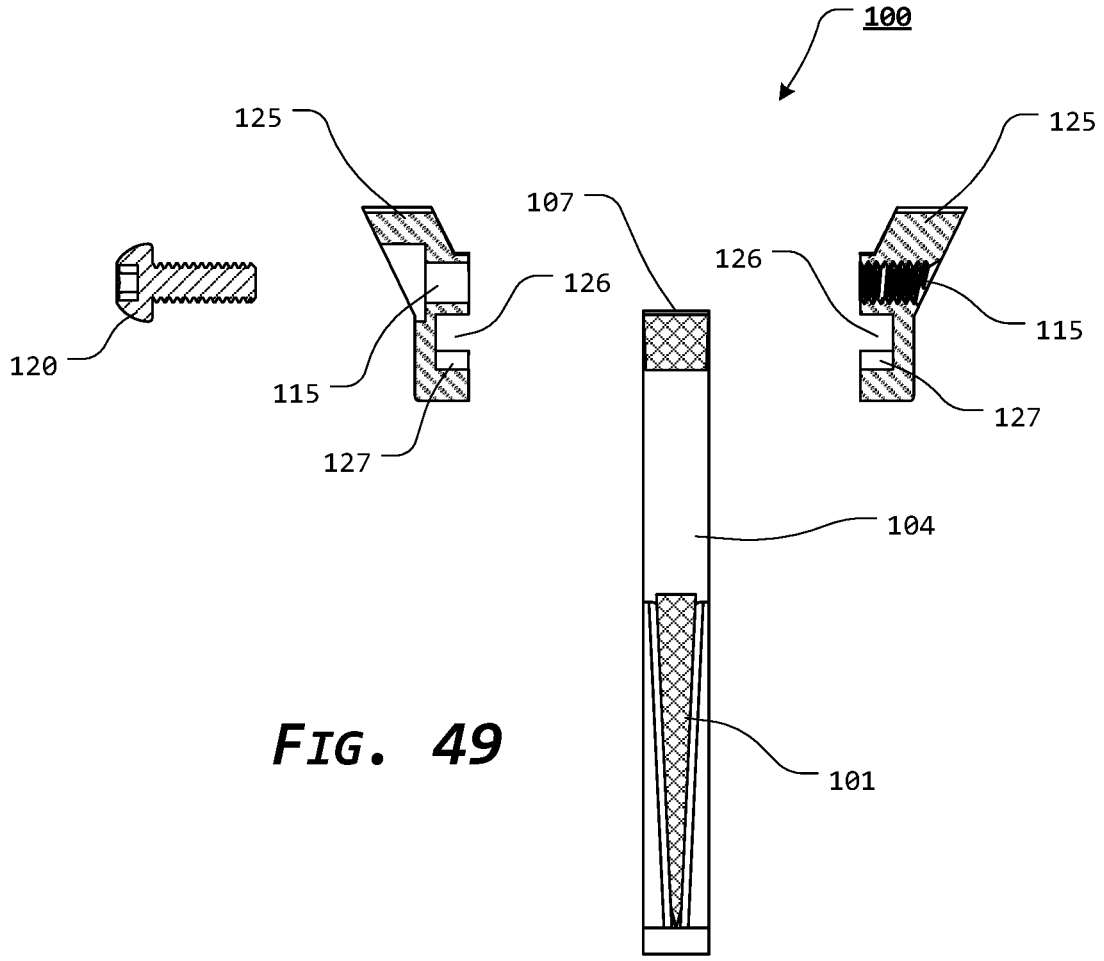
FIG. 49 illustrates a front, cross-sectional view of certain exemplary components of an exemplary embodiment of an assisted opening knife blade, according to the presently disclosed systems, methods, and/or apparatuses.
Figure 50:
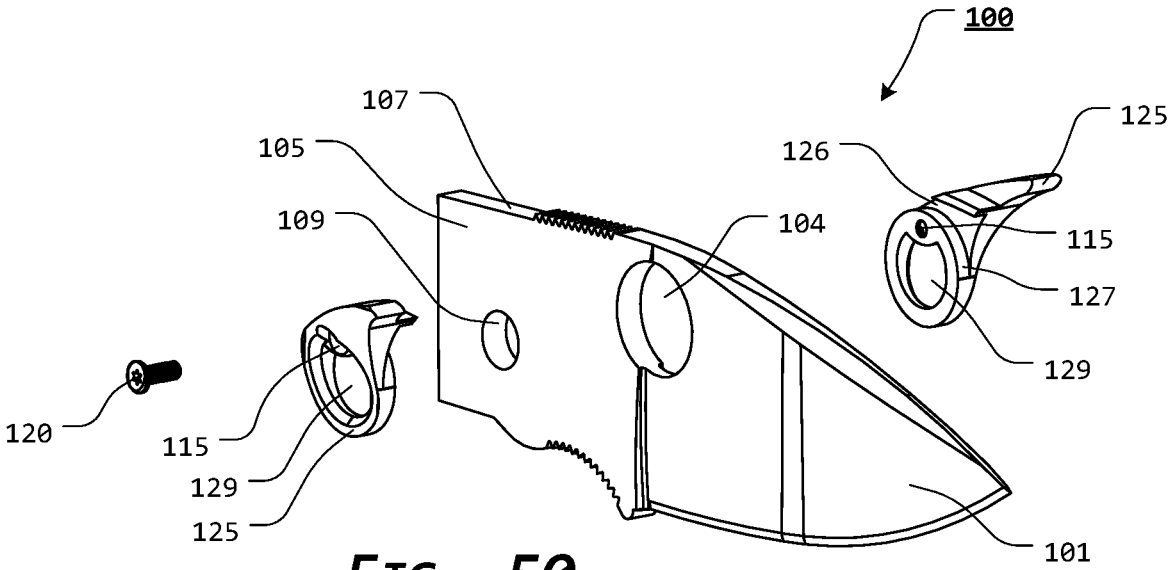
FIG. 50 illustrates an upper, front, exploded, perspective view of certain exemplary components of an exemplary embodiment of an assisted opening knife blade, according to the presently disclosed systems, methods, and/or apparatuses.
Figure 51:
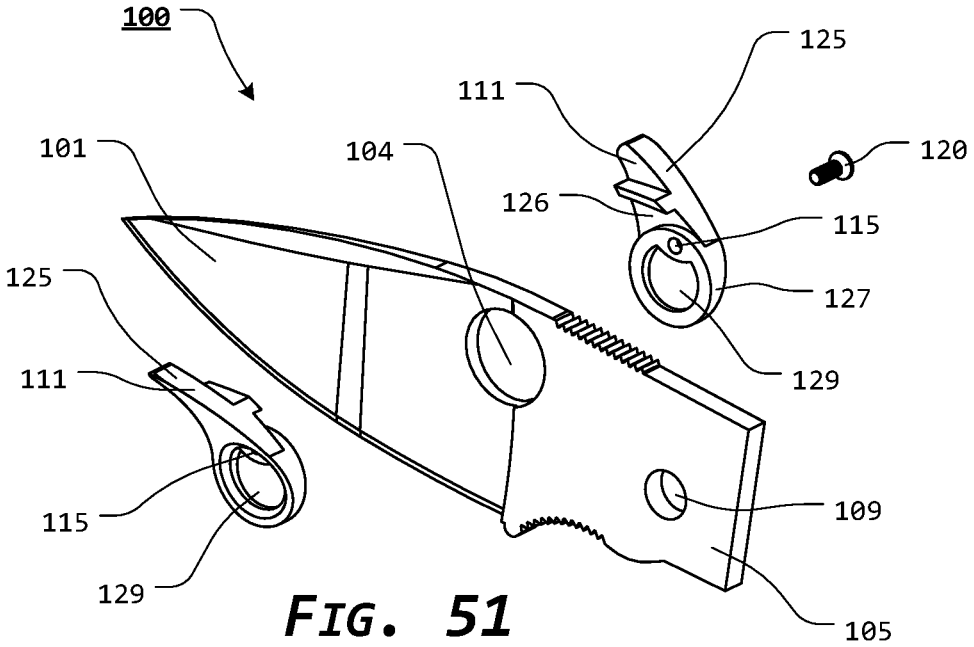
FIG. 51 illustrates an upper, rear, exploded, perspective view of certain exemplary components of an exemplary embodiment of an assisted opening knife blade, according to the presently disclosed systems, methods, and/or apparatuses.
Figure 52:
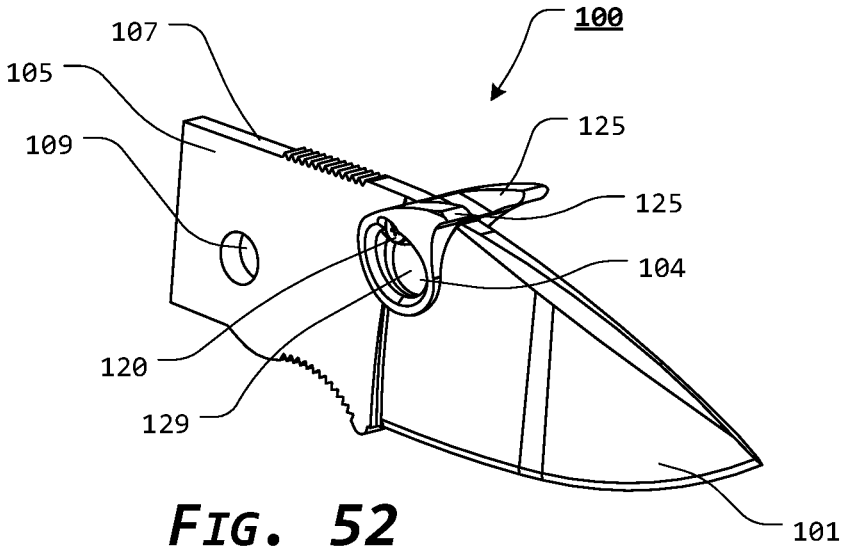
FIG. 52 illustrates an upper, front, perspective view of certain exemplary components of an exemplary embodiment of an assisted opening knife blade, according to the presently disclosed systems, methods, and/or apparatuses.
Figure 53:
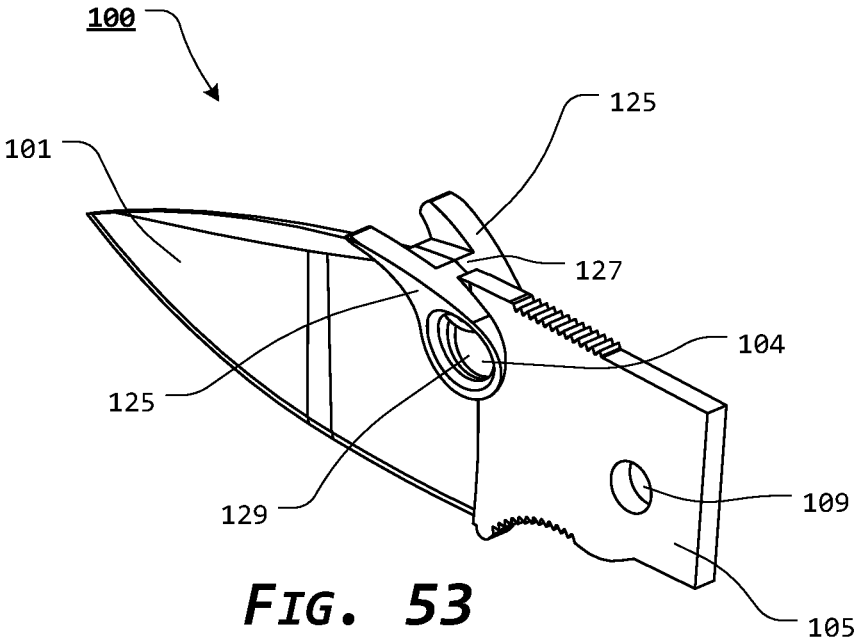
FIG. 53 illustrates an upper, rear, perspective view of certain exemplary components of an exemplary embodiment of an assisted opening knife blade, according to the presently disclosed systems, methods, and/or apparatuses.
Figure 54:
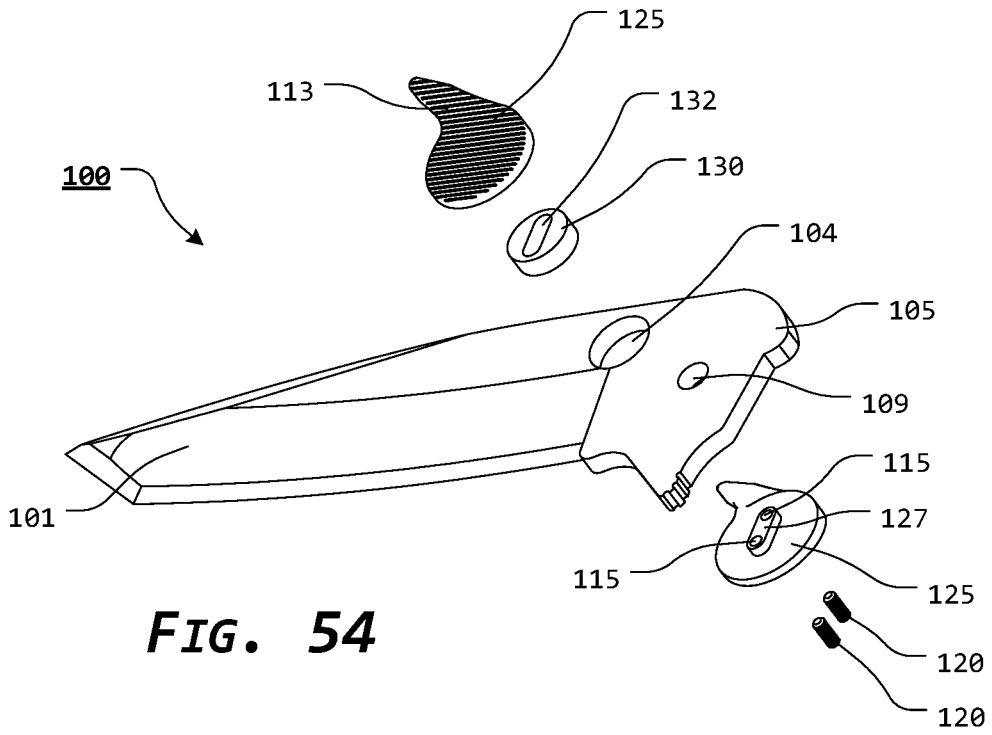
FIG. 54 illustrates a lower, rear, exploded, perspective view of certain exemplary components of an exemplary embodiment of an assisted opening knife blade, according to the presently disclosed systems, methods, and/or apparatuses.
Figure 55:
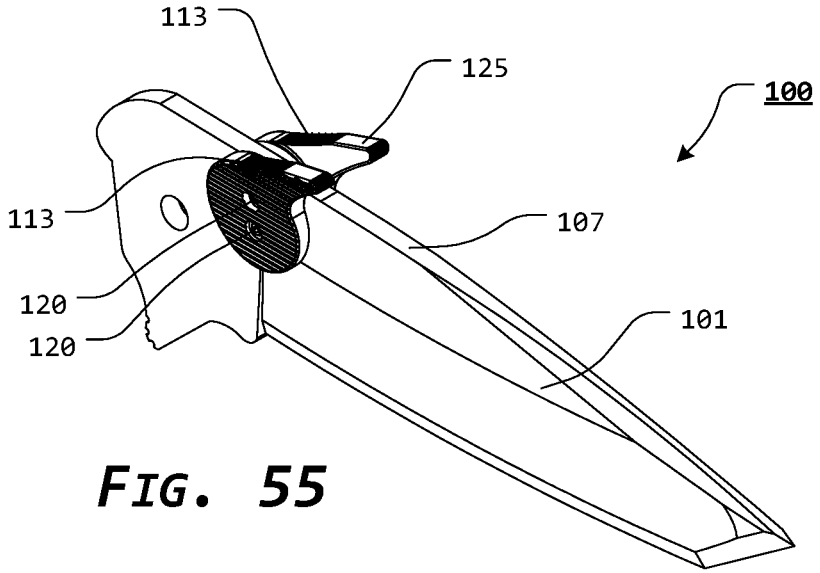
FIG. 55 illustrates an upper, front, perspective view of certain exemplary components of an exemplary embodiment of an assisted opening knife blade, according to the presently disclosed systems, methods, and/or apparatuses.
Figure 56:
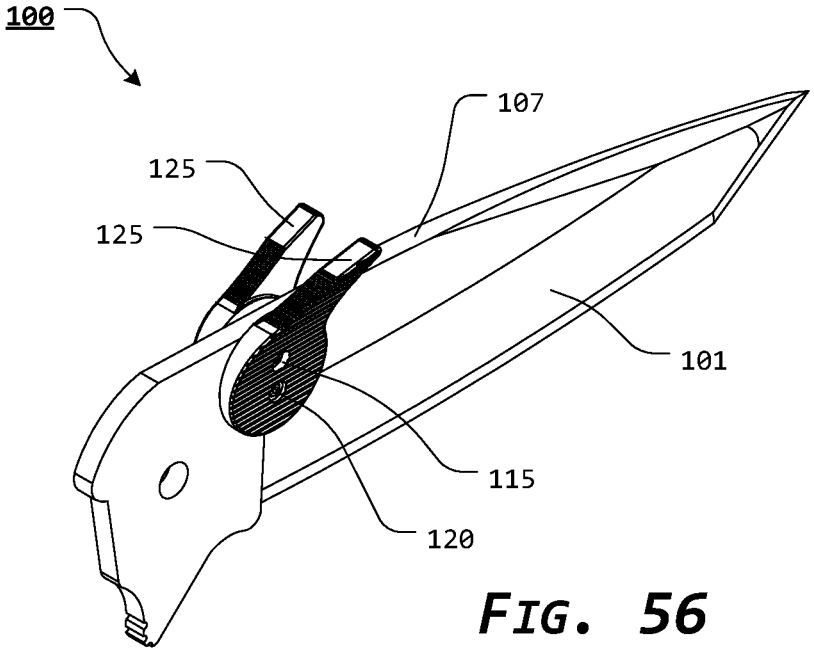
FIG. 56 illustrates an upper, rear, perspective view of certain exemplary components of an exemplary embodiment of an assisted opening knife blade, according to the presently disclosed systems, methods, and/or apparatuses.
Figure 57:
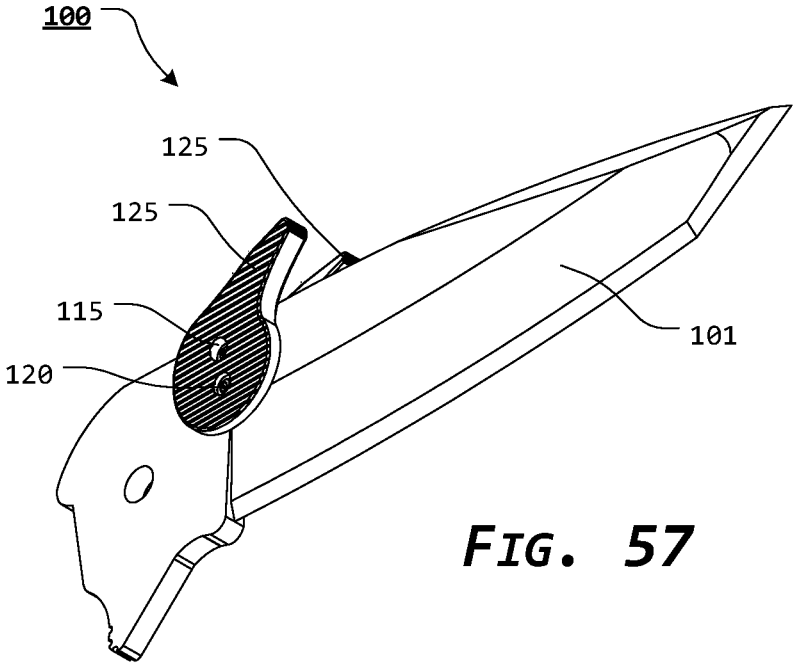
FIG. 57 illustrates a lower, front, perspective view of certain exemplary components of an exemplary embodiment of an assisted opening knife blade, according to the presently disclosed systems, methods, and/or apparatuses.

As illustrated in FIGS. 34-35, the blade aperture 104 is an enlarged aperture, such that the blade aperture 104 is significantly larger than the fastener 120. In these exemplary embodiments, a spacer 130, having a spacer aperture 132 formed therethrough, is positioned within the blade aperture 104. In these exemplary embodiments, the spacer 130 is initially positioned within the blade aperture 104. A portion of the flathead nut sleeve 122 is then positioned through the spacer aperture 132 and the fastener 120 is threadedly inserted within at least a portion of the flathead nut sleeve 122.

As illustrated in FIGS. 36-39, a securing projection 117 extends from a single projection extension 116, taking the place of the flathead nut sleeve 122. Additionally, the fastener 120 is replaced by a fastener element 121 having an externally threaded portion. The external threads of the externally threaded portion of the fastener element 121 correspond to internal threads of the fastener aperture 115 formed at least partially through the securing projection 117.

In this exemplary embodiment, the projection extension 116 is positioned through the blade aperture 104 and the externally threaded portion of the fastener element 121 is threadedly inserted within at least a portion of the fastener aperture 115 formed at least partially through the securing projection 117, thus securing the blade projection module 110 to the knife blade 101.

As illustrated in FIGS. 40-44, the securing projection 117 also includes a tensioning aperture 118 that is at least partially internally threaded. The internal threads of the tensioning aperture 118 correspond to external threads of a tensioning fastener 123. The securing projection 117 is formed so as to only occupy a portion of the blade aperture 104, when the securing projection 117 is positioned within the blade aperture 104. The tensioning aperture 118 is formed so as to allow the tensioning fastener to be at least partially threaded within the tensioning aperture 118 such that the tensioning faster 123 can be at least partially positioned within the securing projection 117 and the securing projection 117 (with the tensioning fastener 123) can be positioned within the blade aperture 104. Once positioned therein, the tensioning fastener 123 can be further tightened within the tensioning aperture 118, such that a terminal portion of the tensioning fastener 123 can contact an interior surface of the blade aperture 104. While contacting and being urged against the interior surface of the blade aperture 104, the terminal portion of the tensioning fastener 123 is able to provide tension between at least a portion of the securing projection 117 and a portion of the interior surface of the blade aperture 104. This tensioning force works to secure the securing projection 117 within the blade aperture 104.

Once appropriately secured, a securing plate 150 can be aligned with at least a portion of the blade aperture 104 and the securing projection 117. Once the securing plate 150 is aligned with the blade aperture 104 and the securing projection 117, fasteners 120 can be positioned through securing plate apertures 152 to threadedly interact with a corresponding fastener apertures 115 formed within the securing projection 117 to secure the securing plate 150 to the blade projection module 110.

As illustrated in FIGS. 45-49, the blade projections 111 are each formed of an individual blade projection component 125. In various exemplary embodiments, each blade projection component 125 is a substantial mirror image of the other blade projection component 125. The blade projection components 125 are formed so as to be positioned on either side of the knife blade 101 and interact with at least a portion of the blade aperture 104 to be attached or coupled to the knife blade 101.

A blade projection component recess 126 is formed within and interior portion of each played projection component 125 is formed so as to at least partially correspond to a relevant portion of the knife blade 101, proximate the blade aperture 104.

In this manner, when the blade projection components 125 are appropriately aligned with the knife blade 101 and each other, at least a portion of each blade projection component protrusion 127 extends into at least a portion of the blade aperture 104 at least a portion of the knife blade 101 proximate the blade aperture 104 is captured within the blade projection component recesses 126.

Once appropriately aligned, a fastener 120 is positioned through (or threadedly inserted through) a fastener aperture 115 formed in a first blade projection component 125 and into an aligned fastener aperture 115 formed in the second blade projection component 125. Interaction between the fastener 120 and at least one of the fastener apertures 115 acts to secure the blade projection components 125 to one another and to the knife blade 101.

As illustrated in FIGS. 50-53, the blade projection component protrusion 127 may extend to form a blade projection component aperture 129. In these exemplary embodiments, at least a portion of the blade projection component protrusion 127 is positionable within the blade aperture 104 and the blade projection component aperture 129 provides a reduced diameter aperture in place of the blade aperture 104.

FIGS. 54-57 illustrate an exemplary embodiment wherein a spacer 130, having a spacer aperture 132 formed therein, is positioned within the blade aperture 104 and opposing blade projection components 125 are attached or coupled on either side of the knife blade 101. Fasteners 120 are utilized to further secure the opposing blade projection components 125 to one another.

Figure 58:
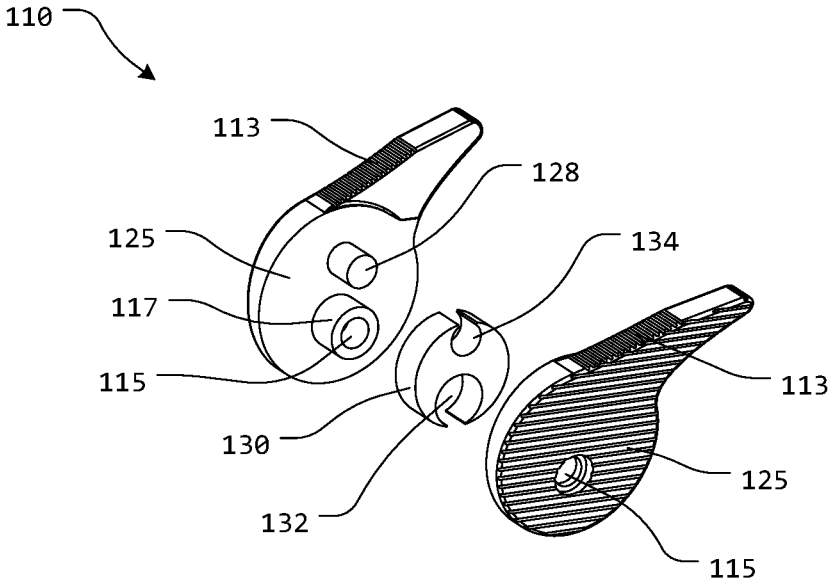
FIG. 58 illustrates an upper, rear, exploded, perspective view of certain exemplary components for an exemplary embodiment of an assisted opening knife blade, according to the presently disclosed systems, methods, and/or apparatuses.
Figure 59:
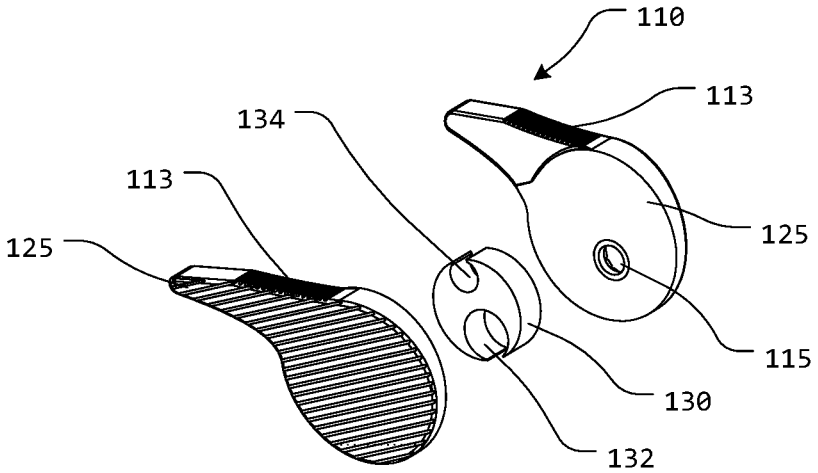
FIG. 59 illustrates an upper, rear, exploded, perspective view of certain exemplary components for an exemplary embodiment of an assisted opening knife blade, according to the presently disclosed systems, methods, and/or apparatuses.

As illustrated in FIGS. 58-59, a supplemental blade projection component protrusion 128 may extend from one or more of the blade projection components 125. In these exemplary embodiments, a supplemental spacer aperture 134 may also be formed in the spacer 130, to accommodate the supplemental blade projection component protrusion 128.

Figure 60:
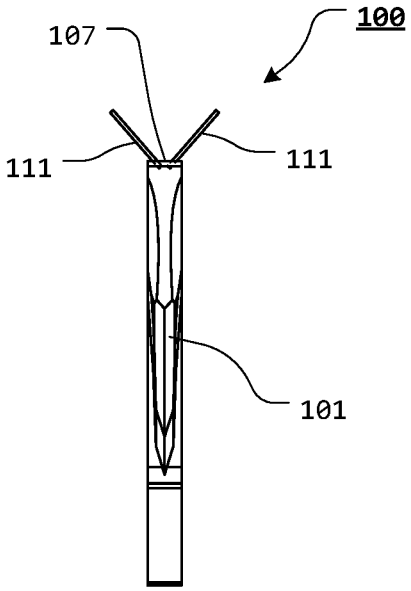
FIG. 60 illustrates a front view of certain exemplary components of an exemplary embodiment of an assisted opening knife blade, according to the presently disclosed systems, methods, and/or apparatuses.

As illustrated in FIG. 60, in various exemplary, nonlimiting embodiments, each blade projection 111 may optionally form an elongate, substantially cylindrical element that extends from the knife blade 101. Each blade projection 111 may be anchored within a blade fastener recesses 103 formed in the knife blade 101.

The blade projections 111 may optionally comprise individual blade projections 111 that include a threaded portion extending from a terminal end of each blade projection 111. The knife blade 101 also includes mating threaded recesses formed in one or more portions of the knife blade 101. The blade fastener recesses 103 may be formed primarily on the sides of the knife blade 101, the spine 107 of the knife blade 101, or proximate the intersection of the spine 107 and the side of the knife blade 101. Each blade projection 111 may be threadably attached to the knife blade 101 via interaction of the threaded portion of the blade projection 111 and of the blade fastener recess 103 of the knife blade 101. It should be appreciated that the blade projections 111 may take on a variety of shapes.

Figure 61:
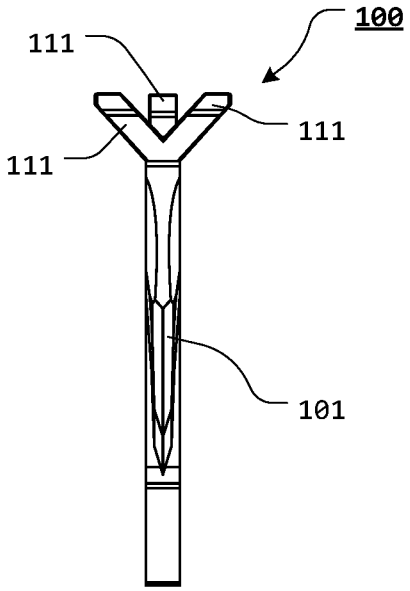
FIG. 61 illustrates a front view of certain exemplary components of an exemplary embodiment of an assisted opening knife blade, according to the presently disclosed systems, methods, and/or apparatuses.

As illustrated in FIG. 61, the blade projections 111 may comprise three blade projections 111, one blade projection 111 extending substantially perpendicular to the longitudinal axis of the knife blade 101 (parallel to the sagittal plane) and two other blade projections 111, each extending from the spine 107 of the knife blade 101 such that an angle, e, formed between a substantially planar knife blade 101 surface and a substantially planar outer blade projection 111 surface of one of the blade projections 111 is less than 180°. In various exemplary embodiments, the angle, e, is about 135°, alternatively, the angle, e, may be between about 165° and about 115°. Thus, the two blade projections 111 extend to form a "V" shape, when viewed from the front of the knife.

Figure 62:
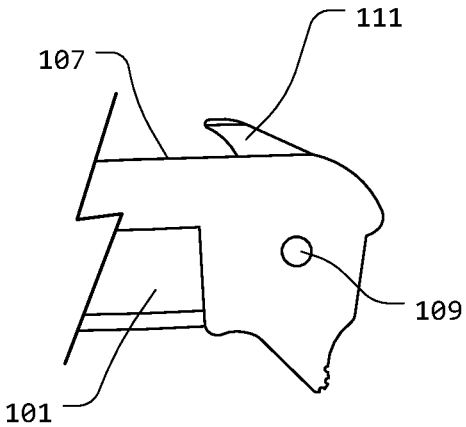
FIG. 62 illustrates partial, side view of certain exemplary components of an exemplary embodiment of an assisted opening knife blade, according to the presently disclosed systems, methods, and/or apparatuses.
Figure 63:
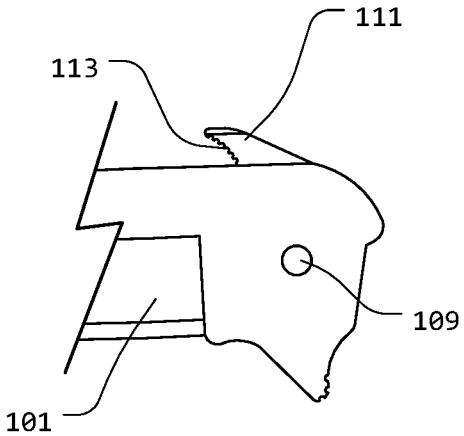
FIG. 63 illustrates partial, side view of certain exemplary components of an exemplary embodiment of an assisted opening knife blade, according to the presently disclosed systems, methods, and/or apparatuses.
Figure 64:
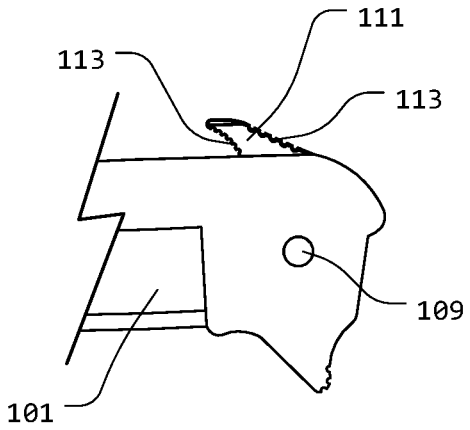
FIG. 64 illustrates partial, side view of certain exemplary components of an exemplary embodiment of an assisted opening knife blade, according to the presently disclosed systems, methods, and/or apparatuses.

As illustrated in FIG. 62, the blade projections 111 may be formed without textured portions 113. In other exemplary embodiments, as illustrated in FIG. 63, the textured portions 113 may be formed on a surface of the blade projections 111 facing the tip of the knife blade 101. In still other exemplary embodiments, as illustrated in FIG. 64, the textured portions 113 may be formed on multiple forward facing and/or rearward facing surfaces of the blade projections 111.

Figure 65:
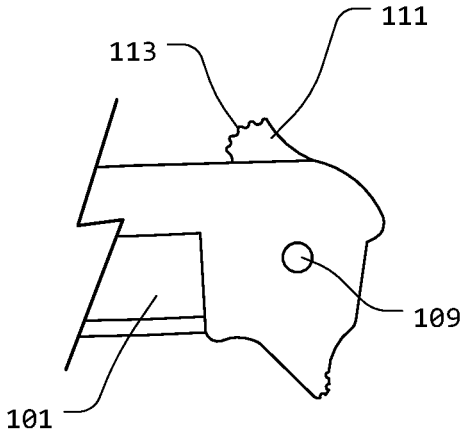
FIG. 65 illustrates partial, side view of certain exemplary components of an exemplary embodiment of an assisted opening knife blade, according to the presently disclosed systems, methods, and/or apparatuses.
Figure 66:
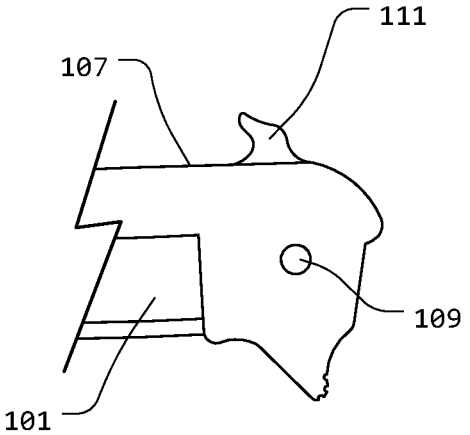
FIG. 66 illustrates partial, side view of certain exemplary components of an exemplary embodiment of an assisted opening knife blade, according to the presently disclosed systems, methods, and/or apparatuses.

FIGS. 65-67 illustrate a variety of alternative profiles that the blade projections 111 may optionally comprise. As illustrated, the blade projections 111 may be created so as to incorporate various desired shapes and sizes. Additionally, a variety of textured portions 113 may be incorporated into the blade projections 111. It should be appreciated that the overall size, shape, and texturing of the blade projections 111 is a design choice based upon the desired shape and profile of the blade projections 111.

While the presently disclosed systems, methods, and/or apparatuses has been described in conjunction with the exemplary embodiments outlined above, the foregoing description of exemplary embodiments of the presently disclosed systems, methods, and/or apparatuses, as set forth above, are intended to be illustrative, not limiting and the fundamental disclosed systems, methods, and/or apparatuses should not be considered to be necessarily so constrained. It is evident that the presently disclosed systems, methods, and/or apparatuses is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the presently disclosed systems, methods, and/or apparatuses, subject to any specifically excluded limit in the stated range. Where the stated range includes one or both of the limits, ranges excluding either or both of those included limits are also included in the presently disclosed systems, methods, and/or apparatuses.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belong.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the presently disclosed systems, methods, and/or apparatuses and elements or methods similar or equivalent to those described herein can be used in practicing the presently disclosed systems, methods, and/or apparatuses. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the"

include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An assisted opening knife blade, comprising:

a knife blade having a first side surface and a second side surface, wherein said first side surface is formed opposite said second side surface; and a first blade projection and a second blade projection form a V-shape extend away from a spine of said knife blade, when viewed from a front of said knife blade, wherein a sagittal plane extends in a vertical direction and bisects the V-shaped projection, wherein a terminal end of said first blade projection extends beyond said first side surface of said knife blade, wherein a terminal end of said second blade projection extends beyond said second side surface of said knife blade, wherein an acute angle is formed between said first projection and said second projection, wherein an obtuse angle is formed between a surface of said first blade projection and said first side surface of said knife blade, and wherein an obtuse angle is formed between a surface of said second blade projection and said second side surface of said knife blade.

2. The assisted opening knife blade of claim 1, wherein said first blade projection and said second blade projection extend from a spine of said blade.

3. The assisted opening knife blade of claim 1, wherein said first blade projection and said second blade projection extend proximate a pivot point of said knife blade.

4. The assisted opening knife blade of claim 1, wherein each of said first blade projection and said second blade projection is an integral extension of said knife blade.

5. The assisted opening knife blade of claim 1, wherein each of said first blade projection and said second blade projection is attached or coupled, via welding, to said knife blade.

6. The assisted opening knife blade of claim 1, wherein one or more surfaces of said first blade projection and said second blade projection includes a textured portion.

7. An assisted opening knife blade, comprising:

a knife blade having a first side surface and a second side surface, wherein said first side surface is formed opposite said second side surface; and at least one first blade projection and at least one second blade projection forming a V-shape extending away from a spine of said knife blade, when viewed from a front of said knife blade, wherein a sagittal plane extends in a vertical direction and bisects said V-shaped projection, wherein a terminal end of said at least one first blade projection extends beyond said first side surface of said knife blade, wherein a terminal end of said at least one second blade projection extends beyond said second side surface of said knife blade, wherein an acute angle is formed between said at least one first blade projection and said at least one second blade projection, wherein an obtuse angle is formed between a side surface of said at least one first blade projection and said first side surface of said knife blade, and wherein an obtuse angle is formed between a side surface of said at least one second blade projection and said second side surface of said knife blade.

8. The assisted opening knife blade of claim 7, wherein each of said at least one first blade projection and said at least one second blade projection extends from said knife blade proximate a pivot point of said knife blade.

9. The assisted opening knife blade of claim 7, wherein a terminal end portion of each blade projection extends beyond a plane formed by a side surface of said knife blade.

10. The assisted opening knife blade of claim 7, wherein one or more surfaces of each of said at least one first blade projection and said at least one second blade projection includes a textured portion.

11. The assisted opening knife blade of claim 7, wherein each of said at least one first blade projection and said at least one second blade projection is formed as an integral portion of said knife blade.

12. The assisted opening knife blade of claim 7, wherein said at least one first blade projection and said at least one second blade projection are portions of a blade projection module, wherein said blade projection module is attached or coupled to said knife blade.

13. A blade projection module for a knife blade, comprising:

at least one first blade projection and at least one second blade projection, wherein said at least one first blade projection and said at least one second blade projection each extend from a portion of said blade projection module, wherein said blade projection module is configured to be attached or coupled to said knife blade such that said at least one first blade projection and said at least one second blade projection form a V-shape extending away from a spine of said knife blade, when viewed from a front of said knife blade, wherein a sagittal plane extends in a vertical direction and bisects said V-shaped projection, wherein a terminal end of a first one of said at least one first blade projection extends beyond a first side surface of said knife blade and a terminal end of said at least one second blade projection extends beyond a second side surface of said knife blade, wherein said at least one first blade projection extends from said knife blade at an acute angle relative to said at least one second blade projection, wherein an obtuse angle is formed between said at least one first blade projection and said first side surface of said knife blade, and wherein an obtuse angle is formed between said at least one second blade projection and said second side surface of said knife blade.

14. The blade projection module of claim 13, wherein at least one fastener aperture is formed through said blade projection module, so as to be aligned with one or more corresponding blade fastener recesses formed through said knife blade, such that at least one fastener may be positioned through said aligned at least one fastener aperture and at least partially within said aligned at least one blade fastener recess.

15. The blade projection module of claim 13, wherein said blade projection module is attached or coupled to said knife blade.

16. The blade projection module of claim 13, wherein one or two projection extensions extend from said blade projection module, wherein each projection extension is formed so as to be positionable adjacent at least a portion of a surface of said knife blade.

17. The blade projection module of claim 16, wherein at least one fastener aperture is formed through each of said projection extensions.

18. The blade projection module of claim 16, wherein a securing projection extends from at least one of said projection extensions, wherein said projection extension is positionable through a blade aperture formed through said knife blade.

* * * * *